US011274386B2

(12) United States Patent
Takei

(10) Patent No.: US 11,274,386 B2
(45) Date of Patent: Mar. 15, 2022

(54) SEWING MACHINE

(71) Applicant: JANOME SEWING MACHINE CO., LTD., Tokyo (JP)

(72) Inventor: Tatsuo Takei, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 230 days.

(21) Appl. No.: 16/851,973

(22) Filed: Apr. 17, 2020

(65) Prior Publication Data

US 2020/0399805 A1 Dec. 24, 2020

(30) Foreign Application Priority Data

Jun. 20, 2019 (JP) ..... JP2019-114994

(51) Int. Cl.
*D05B 27/00* (2006.01)
*D05B 69/12* (2006.01)
*D05B 69/22* (2006.01)

(52) U.S. Cl.
CPC ..... *D05B 27/00* (2013.01); *D05B 69/12* (2013.01); *D05B 69/22* (2013.01)

(58) Field of Classification Search
CPC ..... D05B 27/00; D05B 27/04; D05B 27/06; D05B 27/08; D05B 27/24; D05B 69/12; D05B 69/22
See application file for complete search history.

(56) References Cited

U.S. PATENT DOCUMENTS

| | | | | |
|---|---|---|---|---|
| 4,368,683 | A * | 1/1983 | Takenoya | D05B 27/24 112/314 |
| 6,082,279 | A * | 7/2000 | Ito | D05B 27/24 112/314 |
| 9,834,877 | B2 | 12/2017 | Oie | |
| 2007/0227419 | A1* | 10/2007 | Hirose | D05B 65/02 112/2 |
| 2009/0107374 | A1* | 4/2009 | Ukai | D05B 27/02 112/470.06 |
| 2016/0281286 | A1 | 9/2016 | Oie | |
| 2017/0121878 | A1* | 5/2017 | Koike | D05B 27/24 |
| 2020/0340160 | A1* | 10/2020 | Ueda | D05B 27/24 |

FOREIGN PATENT DOCUMENTS

JP 2016-185299 A 10/2016

* cited by examiner

*Primary Examiner* — Nathan E Durham
(74) *Attorney, Agent, or Firm* — Nakanishi IP Associates, LLC

(57) ABSTRACT

In a sewing machine, a switching mechanism is coupled to a slide arm of a transmission mechanism included in an upper feed mechanism. When the switching mechanism is operated, the slide arm is switched between a transmission state in which the driving force of a driving cam is transmitted to a feed link mechanism and a non-transmission state in which the driving force of the driving cam is not transmitted to the link mechanism 61. This allows the switching mechanism to switch the slide arm 60A to the non-transmission state. This allows the operation of the feed link mechanism to be suspended, and allows the upper-lower movement of an upper feed dog to be suspended. Accordingly, this contributes to a reduction in vibration and noise in the sewing machine.

5 Claims, 11 Drawing Sheets

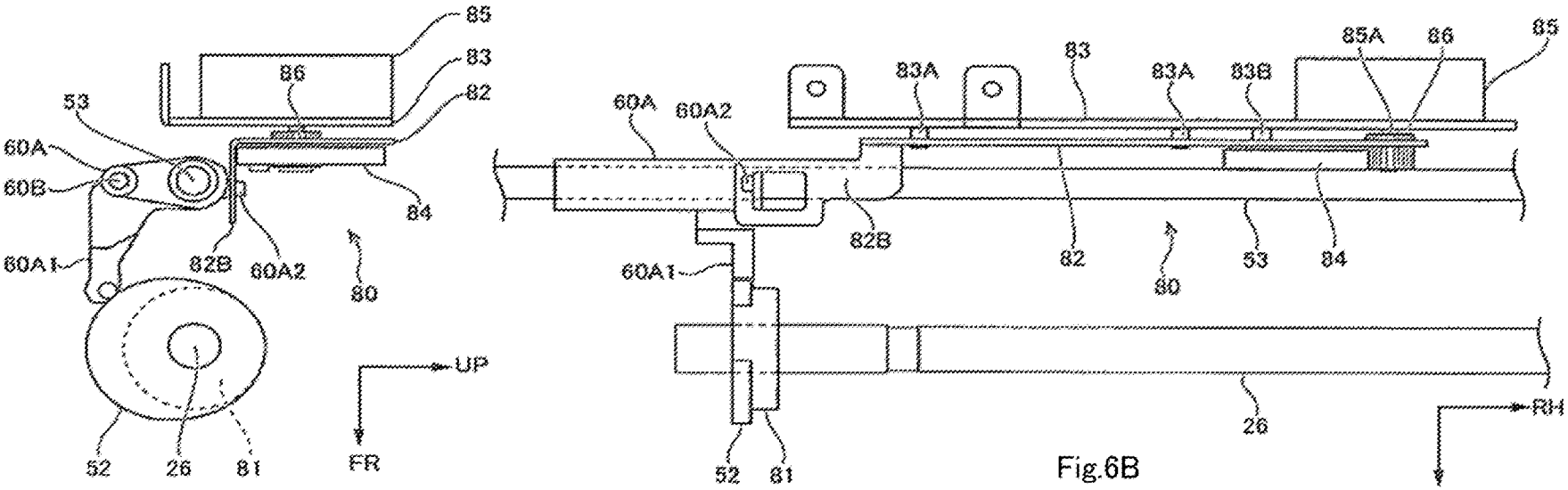
Fig.6B
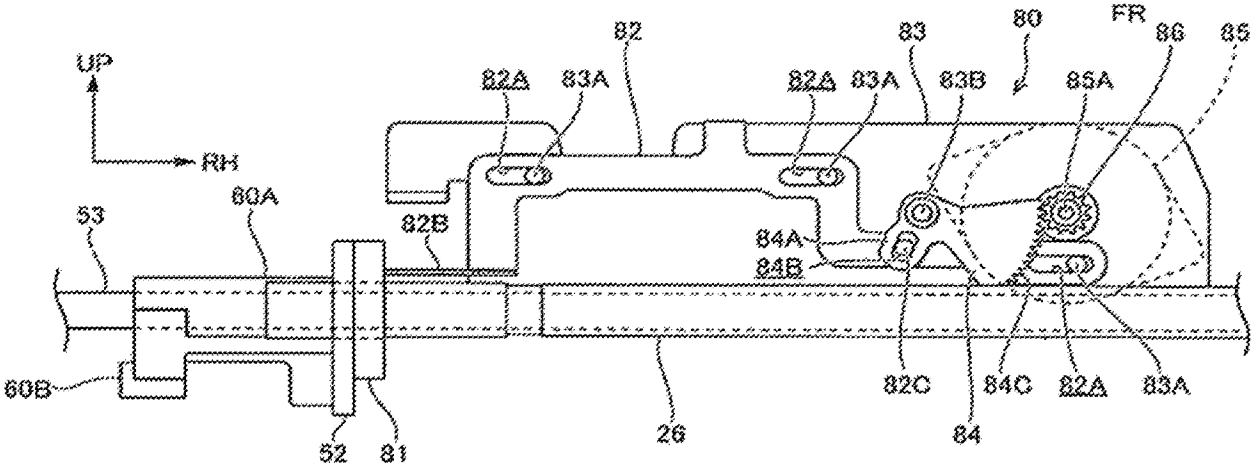
Fig.6C
Fig.6A

SEWING MACHINE

CROSS REFERENCE TO RELATED APPLICATION

This application claims priority to Japanese Patent Application No. 2019-114994 filed on Jun. 20, 2019, the entire content of which is incorporated by reference.

BACKGROUND OF THE INVENTION

1. Field of the Invention

The present invention relates to a sewing machine.

2. Description of the Related Art

A sewing machine described in Patent document 1 listed below includes an upper feed dog and a lower feed dog, and is configured to feed a sewing target backward by the upper feed dog and the lower feed dog. Furthermore, the sewing machine includes an upper feed suspension mechanism that supports a function of suspending the feeding function using the upper feed dog.

RELATED ART DOCUMENTS

Patent Documents

Patent Document 1

Japanese Patent Application Laid Open No. 2016-185299

However, with the sewing machine described above, when the upper feeding function provided by the upper feed dog is suspended by the upper feed suspension mechanism, this suspends the driving of the upper feed dog in the front-rear direction. However, the driving of the upper feed dog in the upper-lower direction is maintained. This has the potential to cause the occurrence of vibration or noise due to the driving of the upper feed dog in the upper-lower direction. Thus, there is room for further improvement from the viewpoint of reducing vibration or noise.

SUMMARY OF THE INVENTION

One or more embodiments of the present invention provide a sewing machine that contributes to the reduction of vibration or noise.

At least one embodiment of the present invention proposes a sewing machine including an upper feed mechanism configured to cause an upper feed dog provided to an upper side of a needle plate to perform a feeding operation. The upper feed mechanism includes: a driving cam provided to an upper shaft such that they can be rotated as a single unit; a link mechanism configured to operate when receiving a transmission of a driving force of the driving cam; a transmission mechanism configured to transmit a driving force of the driving cam to the link mechanism so as to operate the link mechanism; an upper feed leg mounting the upper feed dog, and coupled to the link mechanism such that, when the link mechanism is operated, the upper feed dog is driven in the upper-lower direction; and a switching mechanism configured to switch the transmission mechanism between a transmission state in which the driving force of the driving cam is transmitted to the link mechanism and a non-transmission state in which the driving force of the driving cam is not transmitted to the link mechanism. The switching mechanism switches the transmission mechanism to the non-transmission state so as to suspend the upper-lower movement of the upper feed leg.

At least one embodiment of the present invention also proposes the sewing machine. When the transmission mechanism is set to the non-transmission state, the upper feed dog is set to a stationary state above a presser configured to press a sewing target.

At least one embodiment of the present invention also proposes the sewing machine. The transmission mechanism includes a slide transmission member. The slide transmission member is provided to a feed upper shaft arranged in parallel with the upper shaft such that it can be swung and such that it can be moved in the axial direction of the feed upper shaft.

At least one embodiment of the present invention also proposes the sewing machine. The switching mechanism includes: a stop cam provided to the upper shaft such that the stop cam and the upper shaft can be rotated as a single unit; and a switching member coupled to the slide transmission member, and configured to operate so as to move the slide transmission member in the axial direction of the feed upper shaft in order to switch the position thereof between a first position at which it is coupled to the driving cam and a second position at which it is coupled to the stop cam. The switching mechanism is operated so as to switch the first position to the second position in order to suspend a swinging of the slide transmission member coupled to the stop cam, thereby setting the transmission mechanism to the non-transmission state.

At least one embodiment of the present invention also proposes the sewing machine. The transmission mechanism includes: a first transmission member provided to a feed upper shaft arranged in parallel with the upper shaft, and coupled to the driving cam such that it can be swung and such that, when the driving cam is rotated, the first transmission member is swung; and a second transmission member coupled to the link mechanism, and provided to the feed upper shaft such that it can be swung, such that it can be moved in the axial direction of the feed upper shaft, and such that, when it is moved in the axial direction of the feed upper shaft, it is switched between a first position at which it is coupled to the first transmission member and a second position at which it is away from and disconnected from the first member.

With a sewing machine according to at least one embodiment of the present invention, such a sewing machine is capable of contributing to a reduction in vibration and noise.

BRIEF DESCRIPTION OF THE DRAWINGS

FIG. 6A is a side view showing a switching mechanism shown in FIG. 3 as viewed from the left side, FIG. 6B is a plan view showing the switching mechanism shown in FIG. 6A as viewed from the upper side, and FIG. 6C is a front view showing the switching mechanism shown in FIG. 6A as viewed from the front side.

DESCRIPTION OF THE PREFERRED EMBODIMENTS

First Embodiment

Figure 1:
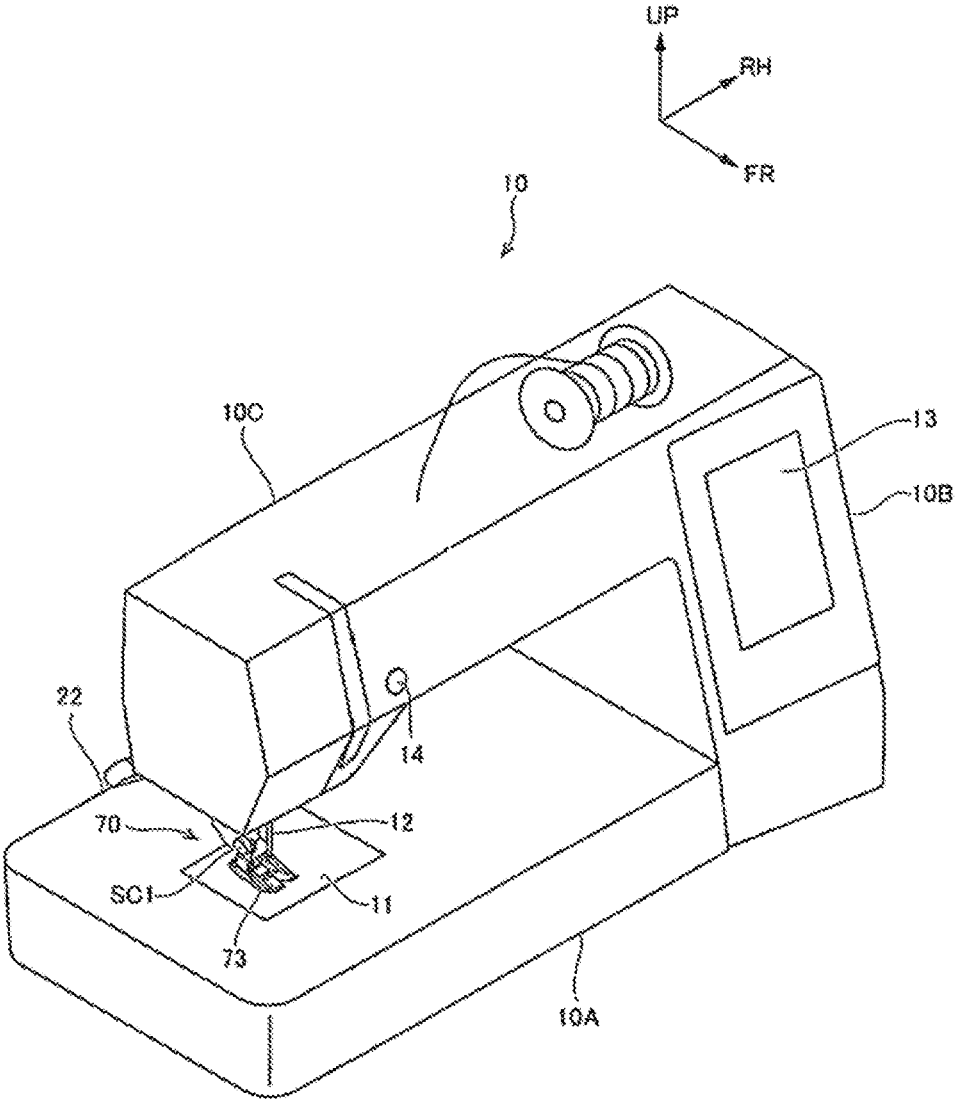
FIG. 1 is a perspective view of a sewing machine according to a first embodiment as viewed diagonally from the front left side.

Description will be made with reference to FIGS. 1 through 10 regarding a sewing machine 10 according to a first embodiment. It should be noted that, in the drawings, the arrow UP indicates the upper side of the sewing machine 10, the arrow FR indicates the front side of the sewing machine 10, and the arrow RH indicates the right side (one side in the width direction) of the sewing machine 10. In the description described below, the upper-lower direction, the front-rear direction, and the left-right direction represent the upper-lower direction, front-rear direction, and left-right direction, of the sewing machine 10, respectively.

[Overall Structure of Sewing Machine 10]

As shown in FIG. 1, the sewing machine 10 has an approximately U-shaped overall structure having an opening that faces the left side in a front view as viewed form the front side. Specifically, the sewing machine 10 is configured including: a bed portion 10A that forms a lower end portion of the sewing machine 10 and that is configured such that it extends in the left-right direction; a leg portion 10B configured such that it extends from the right end portion of the bed portion 10A toward the upper side; and an arm portion 10C configured such that it extends from the upper end portion of the leg portion 10B toward the left side.

Furthermore, a needle plate 11 is provided at an upper-left end portion of the bed portion 10A of the sewing machine 10. A presser 73 of a presser unit 70 described later is provided on the upper side of the needle plate 11. Furthermore, a needle 12 fixed to a needle bar (not shown) is provided on the front side of the presser 73. With such an arrangement, the needle 12 is reciprocated in the upper-lower direction in a state in which a cloth (sewing target) is interposed between the needle plate 11 and the presser 73 in the upper-lower direction, so as to form a stitching pattern on the cloth. Specifically, when the needle 12 is arranged below the needle plate 11 (the upper face of the needle plate 11), a stitching pattern is formed on the cloth. On the other hand, when the needle 12 is arranged above the needle plate 11 (the upper face of the needle plate 11), the cloth is fed toward the rear side by the lower feed dog 35 and the upper feed dog 77. In the following description, a state in which the needle 12 is arranged below the needle plate 11 will be represented as a stitching pattern forming state. On the other hand, a state in which the needle 12 is arranged above the needle plate 11 will be represented as a feeding state.

Furthermore, the sewing machine 10 includes an operating unit 13 including a touch panel. The operating unit 13 is provided to the leg portion 10B of the sewing machine 10 such that it is exposed so as to allow the user to operate it. Such an arrangement allows the user to perform various kinds of settings for the sewing machine 10 using the operating unit 13. Furthermore, an operating button 14 is provided on the front face of the arm portion 10C of the sewing machine 10. With such an arrangement, when the operation of the sewing machine 10 is to be started or suspended, the user presses the operating button 14. Detailed description will be made regarding a configuration of the sewing machine 10.

Figure 2:
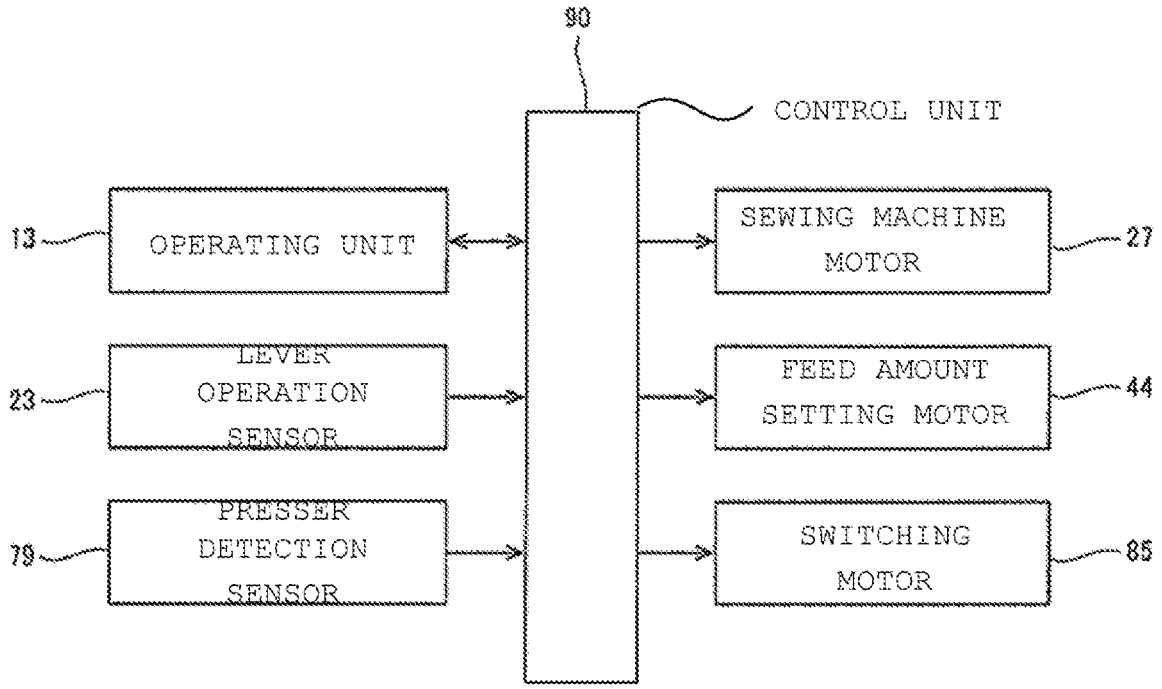
FIG. 2 is a block diagram showing the sewing machine shown in FIG. 1.
Figure 3:
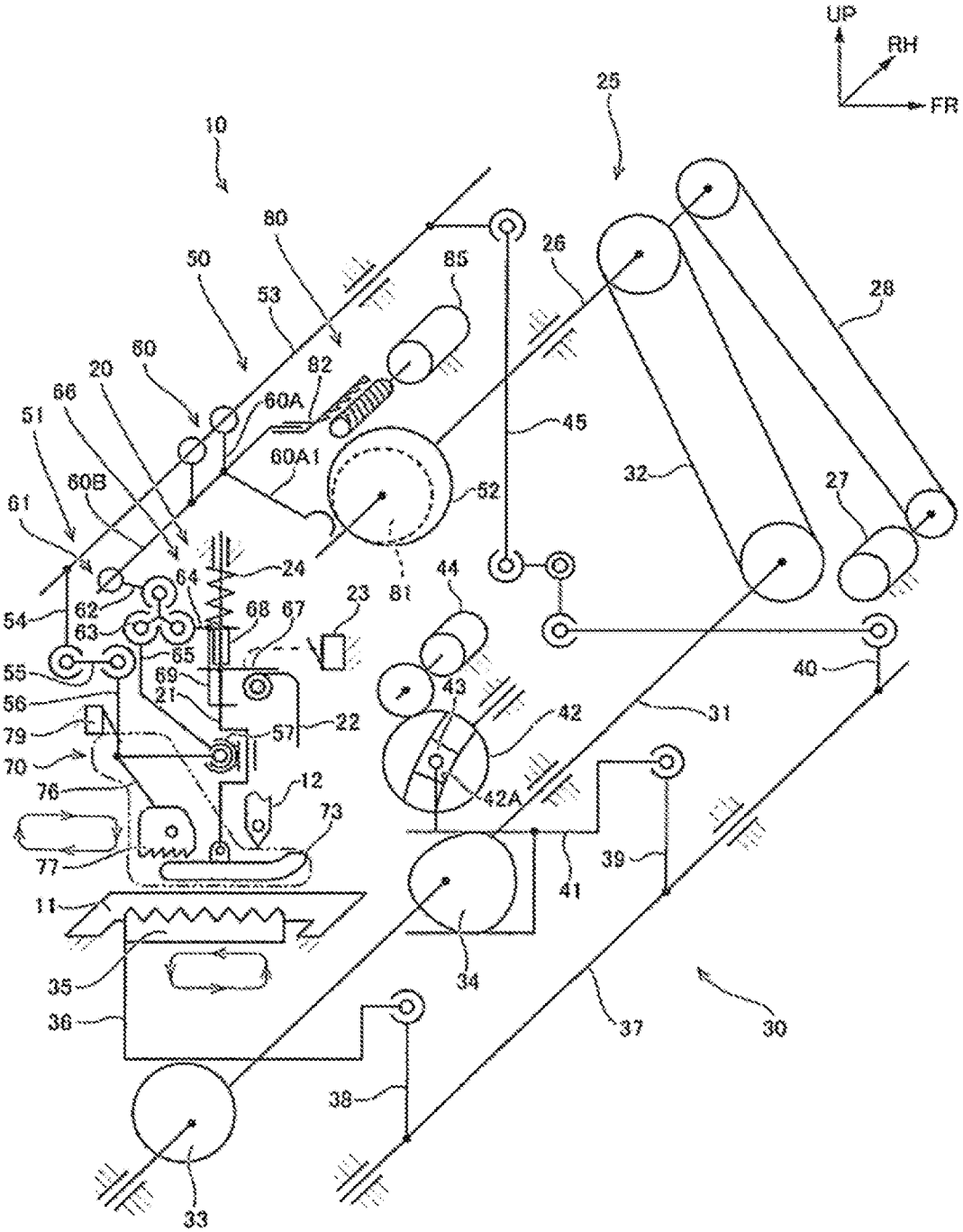
FIG. 3 is a schematic diagram showing an internal configuration of the sewing machine shown in FIG. 1.

As shown in FIG. 3, the sewing machine 10 is configured including a presser mechanism 20, a driving mechanism 25, a lower feed mechanism 30, an upper feed mechanism 50, a presser unit 70, a switching mechanism 80, and a control unit 90 (see FIG. 2).

[Regarding the Presser Mechanism 20]

The presser mechanism 20 includes a presser bar 21. The presser bar 21 is configured in an approximately round bar shape with the upper-lower direction as its axial direction. The presser bar 21 is supported by a frame (not shown) that forms a framework of the sewing machine 10 such that it can be relatively moved in the upper-lower direction. Furthermore, a presser bar holder 67 that forms a spring releasing mechanism 66 described later is fixed to an intermediate portion of the presser bar 21 in the upper-lower direction. The presser bar holder 67 is supported from the lower side by an operating lever 22. With this, the position of the presser bar 21 is set in the upper-lower direction. Furthermore, the operating lever 22 is configured such that it can be rotated with the left-right direction as its axial direction. With such an arrangement, upon rotationally operating the operating lever 22 toward the upper side from the position shown in FIG. 1, the presser bar holder 67 is lifted by the operating lever 22 so as to raise the presser bar 21 from a pressing position at which it presses a cloth up to a lifted position. With this arrangement, before the start of sewing on a cloth, the presser bar 21 is lifted so as to allow the user to set a cloth between the presser unit 70 and the needle plate 11 described later.

Furthermore, the presser mechanism 20 includes a lever operation sensor 23. The lever operation sensor 23 is configured to detect the rotational operation of the operating lever 22 so as to detect the position of the presser bar 21 (pressing position or lifted position). Furthermore, the lever operation sensor 23 is configured to output a detection signal to the control unit 90 described later (see FIG. 2).

A presser spring 24 is mounted on an upper portion of the presser bar 21. The presser spring 24 is configured as a compression coil spring. With such an arrangement, an upper end portion of the presser spring 24 is engaged with the frame. On the other hand, a lower end portion of the presser spring 24 is engaged with the spring releasing mechanism 66 described later. The force generated by the presser spring 24 toward the lower side is applied to the presser bar 21 via the spring releasing mechanism 66.

[Regarding the Driving Mechanism 25]

The driving mechanism 25 is configured as a driving unit for driving the lower feed mechanism 30 described later and the upper feed mechanism 50 described later. The driving mechanism 25 includes an upper shaft 26. The upper shaft 26 is arranged within the arm portion 10C with the left-right direction as its axial direction. The upper shaft 26 is rotatably supported by the frame. Furthermore, the driving mechanism 25 includes a sewing machine motor 27. The sewing machine motor 27 is arranged within the lower end portion of the leg portion 10B with the left-right direction as its axial direction. A motor belt 28 is wound around an output shaft of the sewing machine motor 27 and a right end portion of the upper shaft 26. In this state, the upper shaft 26 and the sewing machine motor 27 are coupled by the motor belt 28. With this arrangement, when the sewing machine motor 27 is driven, the upper shaft 26 is rotated around the axis of the upper shaft 26 itself.

Furthermore, an unshown needle mechanism is coupled to a left end portion of the upper shaft 26. With such an arrangement, the rotational driving force of the upper shaft 26 is transmitted to the needle bar by the needle mechanism. With this, when the upper shaft 26 is rotated, the needle 12 (needle bar) is reciprocated in the upper-lower direction. It should be noted that a needle hole is formed as a through hole in the needle plate 11 at a position that corresponds to the needle drop position of the needle 12. This arrangement allows the needle 12 to pass through the needle hole when the needle 12 is reciprocated in the upper-lower direction. Furthermore, the upper shaft 26 is configured as a driving source for moving the upper feed dog 77 described later in the upper-lower direction.

[Regarding the Lower Feed Mechanism 30]

The lower feed mechanism 30 is configured including a lower shaft 31, the lower feed dog 35, and a feed lower shaft 37.

[Regarding the Lower Shaft 31]

The lower shaft 31 is arranged within the bed portion 10A with the left-right direction as its axial direction, and is rotatably supported by the frame. A coupling belt 32 is wound around a right end portion of the lower shaft 31 and a right end side portion of the upper shaft 26. In this state, the upper shaft 26 and the lower shaft 31 are coupled by the coupling belt 32. With this, when the sewing machine motor 27 is driven, the lower shaft 31 is rotated together with the upper shaft 26.

A first lower feed cam 33 is provided to a left end portion of the lower shaft 31 such that it can be rotated together with the lower shaft 31 as a single unit. The first lower feed cam 33 is configured as an approximately disk-shaped plate cam with the left-right direction as its thickness direction. The first lower feed cam 33 is configured to have an outer circumferential face that functions as a cam face. Furthermore, the first lower cam is arranged such that the axis of the lower shaft 31 (center of rotation of the first lower feed cam 33) is eccentric with respect to the center of the first lower feed cam 33.

A second lower feed cam 34 is provided to an intermediate portion of the lower shaft 31 in the axial direction such that it can be rotated together with the lower shaft 31 as a single unit. The second lower feed cam 34 is configured as an approximately triangular plate-shaped plate cam with the left-right direction as its thickness direction. The second lower feed cam 34 is configured such that its outer circumferential face functions as a cam face. Furthermore, the second lower cam 34 is arranged such that the axis of the lower shaft 31 (center of rotation of the second lower feed cam 34) is eccentric with respect to the center of the second lower feed cam 34.

[Regarding the Lower Feed Dog 35]

Figure 4B:
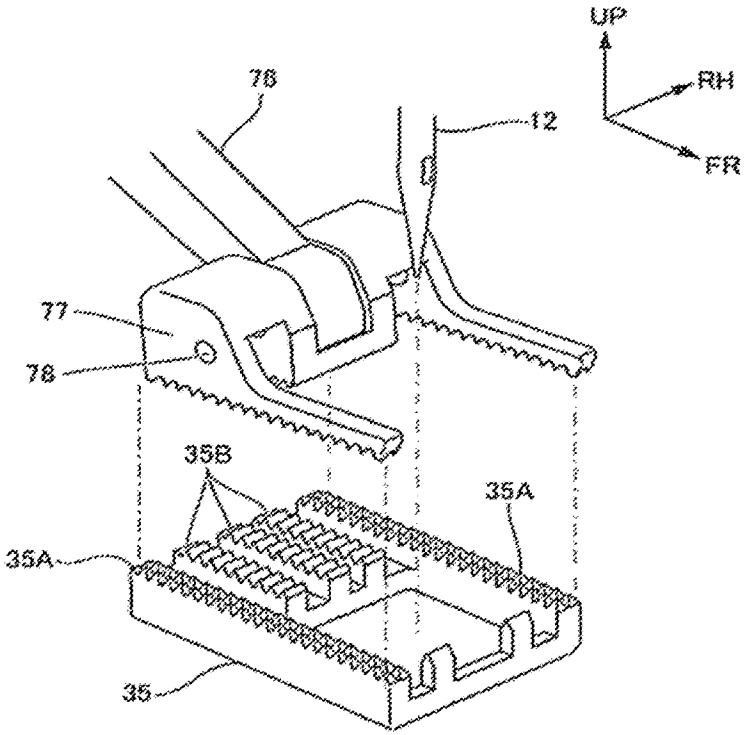
FIG. 4B is a perspective view showing the position relation between an upper feed dog and a lower feed dog shown in FIG. 4A in a state in which a presser main body is removed.
Figure 4A:
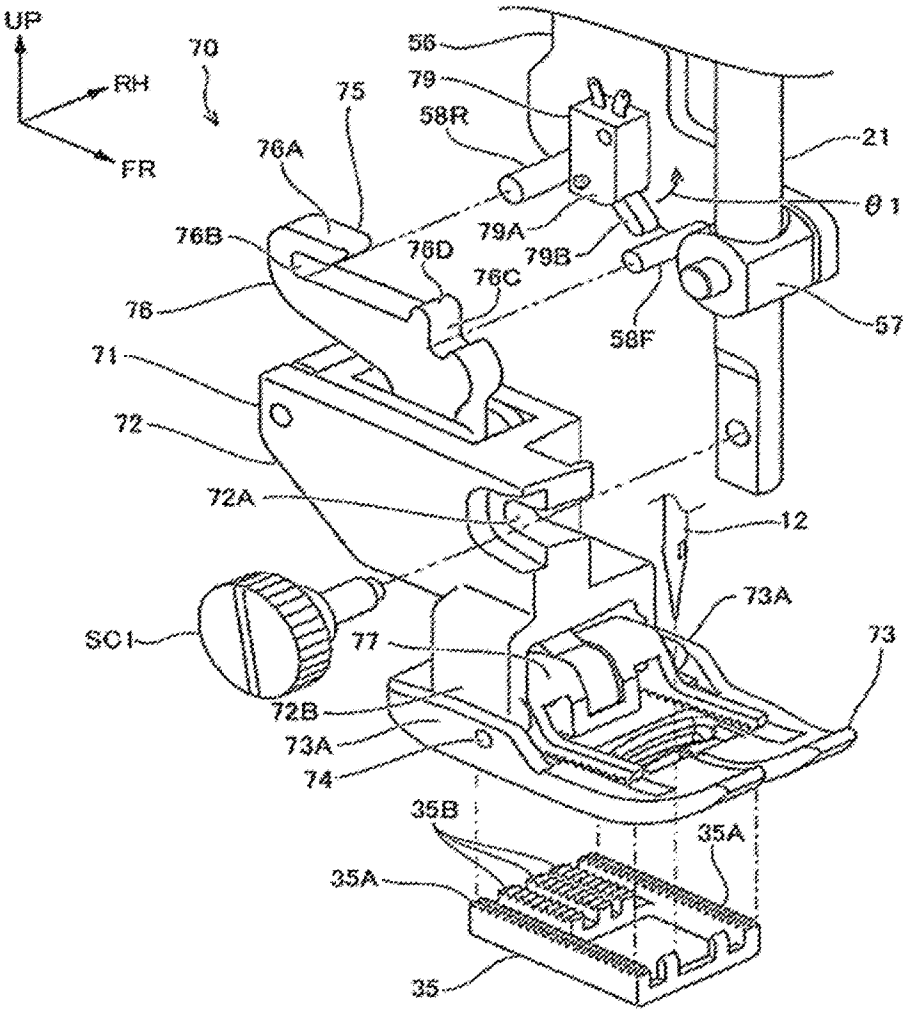
FIG. 4A is an enlarged perspective view showing a presser unit shown in FIG. 1.

As shown in FIGS. 4A and 4B, the lower feed dog 35 is arranged on the lower side of the needle plate 11. A pair of first tooth portions 35A is formed in the upper end portion of the lower feed dog 35 such that they extend in the front-rear direction. Specifically, the first tooth portions 35A are arranged in both end portions of the lower feed dog 35 in the left-right direction. Furthermore, three second tooth portions 35B are formed in an upper end portion of the lower feed dog 35 such that they extend in the front-rear direction. Each second tooth portion 35B is arranged at a rear portion of the lower feed dog 35 between the pair of first tooth portions 35A. Multiple teeth are formed in each of the first tooth portions 35A and the second tooth portions 35B. Furthermore, the front end portion of each first tooth portion 35A is arranged on the front side of the needle drop position of the needle 12. The second tooth portion 35B is arranged such that its entire region is positioned on the rear side of the needle drop position of the needle 12. It should be noted that a hole portion is formed in the needle plate 11, which allows the first tooth portions 35A and the second tooth portions 35B to be inserted when the lower feed mechanism 30 is operated.

As shown in FIG. 3, a feed base 36 is provided on the lower side of the lower feed dog 35. The lower feed dog 35 is fixed to the feed base 36. The feed base 36 is rotatably coupled to a first lower feed arm 38 described later with the left-right direction as its axial direction. Furthermore, the first lower feed cam 33 described above is arranged on the lower side of the feed base 36 such that its cam face is in contact with the feed base 36. With this, when the first lower feed cam 33 is rotated, the feed base (i.e., lower feed dog 35) is reciprocated in the upper-lower direction.

[Regarding the Feed Lower Shaft 37]

The feed lower shaft 37 is arranged on the front side of the lower shaft 31 with the left-right direction as its axial direction. The feed lower shaft 37 is rotatably supported by the frame. The first lower feed arm 38 is provided to the left end portion of the feed lower shaft 37 such that they can be rotated with each other as a single unit. A second lower feed arm 39 is provided to an intermediate portion of the feed lower shaft 37 such that they can be rotated with each other as a single unit. Furthermore, a third lower feed arm 40 is provided to the right end portion of the feed lower shaft 37 such that they can be rotated with each other as a single unit. The first lower feed arm 38, the second lower feed arm 39, and the third lower feed arm 40 are arranged such that they extend from the feed lower shaft 37 toward the outer side of the feed lower shaft 37 in its radial direction.

The feed base 36 described above is rotatably coupled to an end portion of the first lower feed arm 38. With this arrangement, with the reciprocating rotation of the feed lower shaft 37, the first lower feed arm 38 is swung around the axis of the feed lower shaft 37. This reciprocates the feed base 36 (i.e., lower feed dog 35) in the front-rear direction. That is to say, the lower feed dog 35 receives the transmission of the driving in the upper-lower direction due to the rotation of the first lower feed cam 33 and the driving in the front-rear direction due to the swinging of the first lower feed arm 38. With this arrangement, in a side view, the lower feed dog 35 is driven such that it draws an elliptic trajectory. Specifically, the first tooth portions 35A and the second tooth portions 35B are driven from their initial positions such that they protrude from the upper face of the needle plate 11 and move rearward. Furthermore, after the first tooth portions 35A and the second tooth portions 35B of the lower feed dog 35 are moved rearward, the first tooth portions 35A and the second tooth portions 35B are moved downward such that they are located below the needle plate 11. Subsequently, the first tooth portions 35A and the second tooth portions 35B of the lower feed dog 35 are moved toward the front side and raised such that they are arranged at the initial position.

A base end portion of a forked link 41 is coupled to an end portion of the second lower feed arm 39 such that it can be swung with the left-right direction as its axial direction. The forked link 41 is configured to have a forked end portion. With such an arrangement, the second lower feed cam 34 described above is arranged within a space defined by the end portion of the forked link 41. In this state, the cam face of the second lower feed cam 34 is in contact with the inner circumferential face of the end portion of the forked link 41.

A feed setting device 42 is provided in the vicinity of the forked link 41. The feed setting device 42 is rotatably supported by the frame with the left-right direction as its axial direction. A groove portion 42A is formed in the feed setting device 42. An angular piece 43 is slidably inserted into the groove portion 42A. With such an arrangement, the end portion of the forked link 41 is rotatably coupled to the angular piece 43 such that it can be rotated with the left-right direction as its axial direction.

Furthermore, a feed amount setting motor 44 is coupled to the feed setting device 42. With this arrangement, upon driving the feed amount setting motor 44, the feed setting device 42 is rotated. With such an arrangement, when the second lower feed cam 34 is rotated around the axis of the lower shaft 31, the angular piece 43 is slid along the groove portion 42A of the feed setting device 42 so as to swing the forked link 42 in the front-rear direction. This swings the second lower feed arm 39 coupled to the forked link 41, which rotationally reciprocates the feed lower shaft 37 around its axis. Furthermore, the reciprocating rotation of the feed lower shaft 37 is transmitted to the feed base 36 (lower feed dog 35) via the first lower feed arm 38, thereby providing reciprocation of the lower feed dog 35 in the front-rear direction. With such an arrangement, when the feed amount setting motor 44 is driven so as to rotate the feed setting device 42, this changes the tilt angle of the groove portion 42. This changes the amount of swinging of the forked link 41 and the amount of reciprocating rotation of the feed lower shaft 37, thereby changing the feed amount of the lower feed dog 35 in the front-rear direction.

[Regarding the Upper Feed Mechanism 50]

The upper feed mechanism 50 is configured including a feed driving mechanism unit 51 configured to drive the upper feed dog 77 of the presser unit 70 described later, and a spring releasing mechanism 66 configured to release the force of the presser spring 24 applied to the presser bar 21. Furthermore, the upper feed mechanism 50 includes a switching mechanism 80 described later.

[Regarding the Feed Driving Mechanism Unit 51]

The feed driving mechanism unit 51 is configured including a driving cam 52, a feed upper shaft 53, an upper feed arm 54, an upper feed leg 56, a transmission mechanism 60, and a feed link mechanism 61 configured as a "link mechanism".

[Regarding the Driving Cam 52]

Figure 7B:
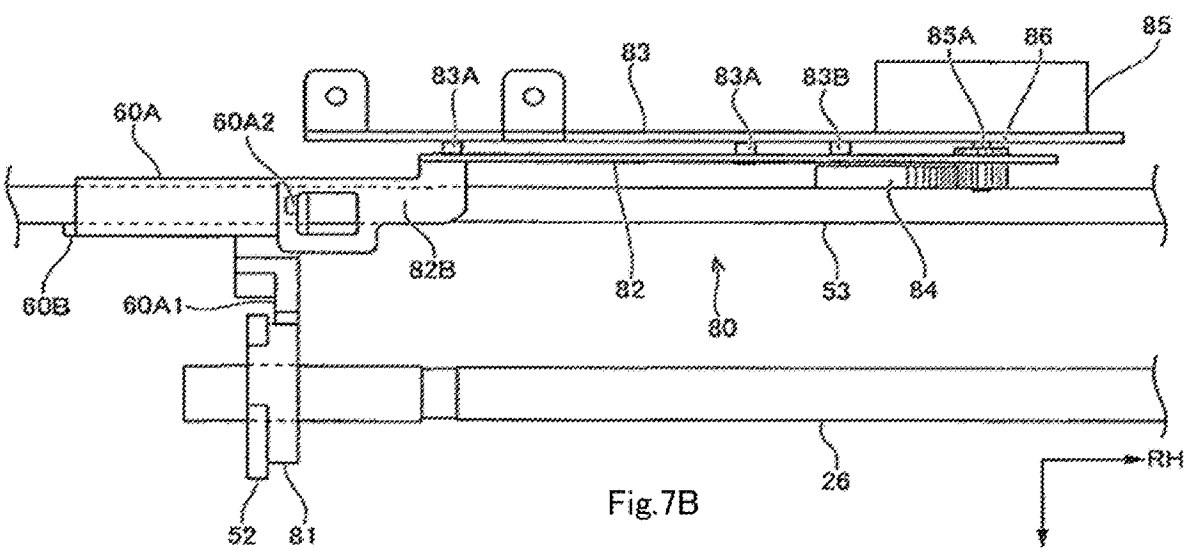
FIG. 7B is a plan view of the switching mechanism shown in FIG. 7A as viewed from the upper side.
Figure 7C:
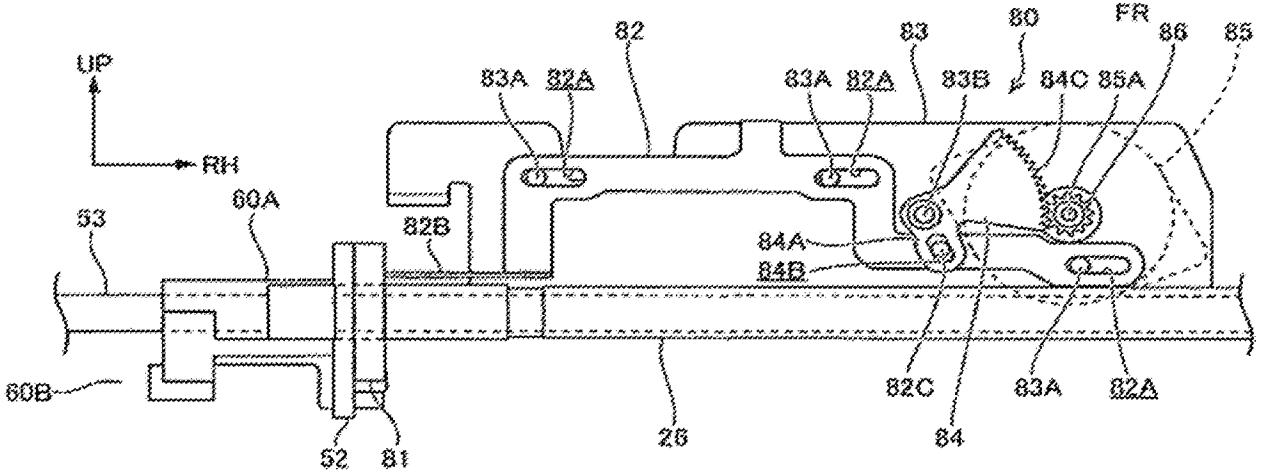
FIG. 7C is a front view of the switching mechanism shown in FIG. 7A as viewed from the front side.
Figure 7A:
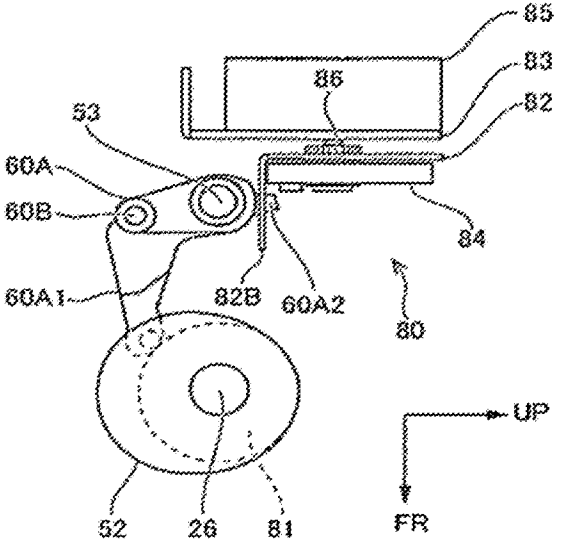
FIG. 7A is a side view showing a state as viewed from the left side in which a slide member of the switching mechanism shown in FIG. 6 is switched to a second position.

As shown in FIGS. 3, 6, and 7, the driving cam 52 is provided to the left end portion of the upper shaft 26 such that they can be rotated together as a single unit. The driving cam 52 is configured as an approximately circular plate cam with the left-right direction as its thickness direction. Furthermore, the driving cam 52 is configured to have an outer circumferential face that functions as a cam face. With such an arrangement, the driving cam 52 is arranged such that the axis of the upper shaft 26 (center of rotation of the driving cam 52) is eccentric with respect to the center of the driving cam 52.

[Regarding the Feed Upper Shaft 53]

The feed upper shaft 53 is arranged on the rear side of the upper shaft 26 with the left-right direction as its axial direction. The feed upper shaft 53 is rotatably supported by the frame. The coupling link mechanism 45 (see FIG. 3) is provided between the feed upper shaft 53 and the feed lower shaft 37 of the lower feed mechanism 30. The feed upper shaft 53 is coupled to the feed lower shaft 37 via the coupling link mechanism 45. Specifically, one end portion of the coupling link mechanism 45 is coupled to the right end portion of the feed upper shaft 53. The other end portion of the coupling link mechanism 45 is coupled to an end portion of the third lower feed arm 40 of the feed lower shaft 37. With this arrangement, the feed upper shaft 53 is rotationally reciprocated around its axis together with the reciprocating rotation of the feed lower shaft 37. Furthermore, the feed upper shaft 53 is configured as a driving source configured to move the upper feed dog 77 described later in the front-rear direction.

[Regarding the Upper Feed Arm 54]

As shown in FIG. 3, the upper feed arm 54 is arranged such that it extends in the upper-lower direction. The upper end portion of the upper feed arm 54 is fixed to the left end portion of the feed upper shaft 53 such that they can be rotated as a single unit. The lower end portion of the upper feed arm 54 is rotatably coupled, with the left-right direction as its axial direction, to one end portion of a feed link 55 arranged such that it extends in the front-rear direction.

[Regarding the Upper Feed Leg 56]

The upper feed leg 56 is arranged on the lower side of the upper feed arm 54. In a side view as viewed from the left side, the upper feed leg 56 is configured in an approximately L-shaped structure. With such an arrangement, the upper end portion of the upper feed leg 56 is rotatably coupled, with the left-right direction as its axial direction, to the other end portion of the feed link 55. Furthermore, as shown in FIG. 4A, a coupling body 57 is rotatably coupled, with the left-right direction as its axial direction, to the front end portion of the lower end portion of the upper feed leg 56. The coupling body 57 is coupled to the lower end side portion of the presser bar 21 such that it can be relatively moved in the upper-lower direction. With this arrangement, with the reciprocating rotation of the feed upper shaft 53 around its axis, the upper feed leg 56 rotates with the coupling portion of the coupling body 57 as the center of rotation.

Furthermore, a pair of front and rear coupling shafts 58F and 58R are provided to the lower end portion of the upper feed leg 56 in order to mount the presser unit 70 described later. The coupling shafts 58R and 58F are each configured in a cylindrical shape with the left-right direction as its axial direction such that they protrude toward the left side from the upper feed leg 56.

[Regarding the Transmission Mechanism 60]

As shown in FIGS. 6 and 7, the transmission mechanism includes a slide arm 60A configured as a "slide transmission member". The slide arm 60A is configured in an approximately rectangular block shape such that it extends in the upper-lower direction. With such an arrangement, the upper end portion of the slide arm 60A is supported by the feed upper shaft 53 such that it can be swung. An arm portion 60A1 is integrally formed in the lower end portion of the right end portion of the slide arm 60A such that it extends frontward. Furthermore, the slide arm 60A is forced frontward (toward the driving cam 52 side) by an unshown force-applying spring. In this state, the end portion of the arm portion 60A1 of the slide arm 60A is in contact with the cam face of the driving cam 52. With this, the slide arm 60A is coupled to the driving cam 52. Upon rotating the driving cam 52, this swings the slide arm 60A around the axis of the feed upper shaft 53 according to the shape of the cam face. Furthermore, the slide arm 60A is configured such that it can be relatively moved in the axial direction of the feed upper shaft 53 with respect to the feed upper shaft 53.

A coupling protrusion 60A2 is integrally formed in the upper end portion of the slide arm 60A such that it protrudes upward. Furthermore, a coupling shaft 60B is integrally provided to the lower end portion of the slide arm 60A such that they can be swung together as a single unit. The coupling shaft 60B is configured in a cylindrical shape with the left-right direction as its axial direction such that it extends toward the left side from the slide arm 60A. With this arrangement, when the slide arm 60A is swung, the coupling shaft 60B is swung around the axis of the feed upper shaft 53.

[Regarding the Feed Link Mechanism 61]

As shown in FIG. 3, the feed link mechanism 61 is configured including a coupling link 62, a triangular link 63, and a switching link 65.

The coupling link 62 is arranged on the front side of the coupling shaft 60B of the slide arm 60A. One end portion of the coupling link 62 is rotatably coupled to the coupling shaft 60B.

The triangular link 63 is configured in an approximately triangular plate shape with the left-right direction as its thickness direction. The triangular link 63 is arranged on the front side of the coupling link 62. With such an arrangement, the upper end of the triangular link 63 is rotatably coupled to the other end portion of the coupling link 62 with the left-right direction as its axial direction. With this, the triangular link 63 and the slide arm 60A are coupled via the coupling link 62. With such an arrangement, when the driving cam 52 is rotated, the slide arm 60A is swung according to the shape of the cam face of the driving cam 52, thereby operating the triangular link 63.

One end portion of the release link 64 is rotatably coupled to the lower end portion of the triangular link 63 such that it can be rotated with the left-right direction as its axial direction. The other end portion of the release link 64 is rotatably coupled to a spring holder 69 of the spring releasing mechanism 66 described later.

The switching link 65 is arranged on the lower side of the triangular link 63 such that it extends in the upper-lower direction. With such an arrangement, the upper end portion of the switching link 65 is rotatably coupled to the lower end portion of the triangular link 63 with the left-right direction as its axial direction. On the other hand, the lower end portion of the switching link 65 is rotatably coupled to the coupling body 57 described above with the left-right direction as its axial direction. With this, the switching link 65 is coupled to the upper feed leg 56 via the coupling body 57. With such an arrangement, when the driving cam 52 is rotated, the slide arm 60A is swung according to the shape of the cam face of the driving cam 52. This rotates the triangular link 63 with the coupling portion that couples it and the release link 64 as the center of rotation. This reciprocates the switching link 65 and the coupling body 57 in the upper-lower direction.

[Regarding the Spring Releasing Mechanism 66]

The spring releasing mechanism 66 is configured including a presser bar holder 67, a spring receiver 68, and a spring holder 69.

[Regarding the Presser Bar Holder 67]

The presser bar holder 67 is arranged such that it extends in the front-rear direction. With such an arrangement, one end portion of the presser bar holder 67 is fixed to an intermediate portion of the presser bar 21 in the longitudinal direction. Furthermore, the other end portion of the presser bar holder 67 is supported from the lower side by the operating lever 22 described above.

[Regarding the Spring Receiver 68]

The spring receiver 68 is configured in an approximately cylindrical shape with the upper-lower direction as its axial direction. With such an arrangement, the presser bar 21 is arranged such that it passes through the internal space of the spring receiver 68 and such that it can be relatively moved. The spring receiver 68 is arranged adjacent to the upper side of the one end portion of the presser bar holder 67.

[Regarding the Spring Holder 69]

The spring holder 69 is configured in an approximately U-shaped plate shape having an opening that faces the front side. With such an arrangement, the upper end portion and the lower end portion of the spring holder 69 are coupled to the presser bar 21 such that they are relatively moved with respect to the presser bar 21 in the upper-lower direction. Furthermore, the one end portion of the presser bar holder 67 and the spring receiver 68 are arranged between the upper end portion and the lower end portion of the spring holder 69. Furthermore, the upper end portion of the spring holder 69 supports the lower end portion of the presser spring 24 from the lower side. The spring holder 69 is forced downward due to the force applied by the presser spring 24. With this, the upper end portion of the spring holder 69 is pressed in contact with the upper end of the spring receiver 68. In this state, the force applied by the presser spring is transmitted to the presser bar 21 via the spring holder 69, the spring receiver 68, and the presser bar holder 67. It should be noted that the lower end portion of the spring holder 69 is arranged below the presser bar holder 67 with a gap between them.

Furthermore, the other end portion of the release link 64 described above is rotatably coupled to the spring holder 69 with the left-right direction as its axial direction. With such an arrangement, when the upper feed dog 77 described later is pressed in contact with the needle plate or the lower feed dog 35, the feed link mechanism 61 operates the spring releasing mechanism 66. With this arrangement, when the spring releasing mechanism 66 operates, the spring holder 69 is relatively moved upward with respect to the presser bar 21 against the force applied by the presser spring 24. With such an arrangement, in this stage, the upper end portion of the spring holder 69 is shifted upward away from the spring receiver 68. Accordingly, in this state, such an arrangement releases the application of the force of the presser spring 24 to the presser bar 21.

[Regarding the Presser Unit 70]

As shown in FIGS. 4A and 4B, the presser unit 70 is configured including a presser main body 71 configured to press a cloth from the upper side, and an upper feed dog unit 75 configured to feed the cloth rearward together with the lower feed dog 35 described above. Furthermore, the upper feed dog unit 75 is coupled to the presser main body 71 such that they form the presser unit 70 configured as a unit.

[Regarding the Presser Main Body 71]

The presser main body 71 includes a presser holder 72 and a presser 73.

As viewed from the rear side, the presser holder 72 as a whole is configured in an approximately U-shaped block structure having an opening that faces the lower side. A fixing groove 72A is formed in the front end portion of the presser holder 72 such that it passes through in the left-right direction. In a side view, the fixing groove 72A is formed in an approximately U-shaped structure having an opening that faces the front side. With such an arrangement, a fixing screw SC1 is inserted into the fixing groove 72A. In this state, the presser holder 72 is fastened and fixed to the lower end portion of the presser bar 21 by the fixing screw SC1. With this, the presser holder 72 (presser main body 71) is detachably fixed to the presser bar 21.

A pair of left and right presser mount portions 72B are integrally formed in the lower end portion of the presser holder 72 in order to mount the presser 73 described later. The presser mount portions 72B are each configured such that they extend downward from both end portions of the lower end portion of the presser holder 72 in the width direction.

The presser 73 is configured in an approximately rectangular plate shape with an approximately upper-lower direction as its thickness direction and with the front-rear direction as its longitudinal direction. Furthermore, in a side view, the presser 73 is configured such that its front end portion smoothly curves upward toward the front side. Furthermore, a pair of left and right mount walls 73A are integrally formed in the left and right side portions of the presser 73, respectively. Each mount wall 73A is configured such that it protrudes upward from the presser 73. With such an arrangement, the mount walls 73A are coupled to the presser mount portions 72B of the presser holder 72 by a mount pin 74 arranged with the left-right direction as its axial direction.

[Regarding the Upper Feed Dog Unit 75]

The upper feed dog unit 75 is configured including an upper feed holder 76 and an upper feed dog 77.

In a side view, the upper feed holder 76 is configured in an approximately crank shape. The upper feed holder 76 is arranged within the presser holder 72. A coupling piece 76A is integrally formed in the rear end portion of the upper end of the upper holder 76 such that it extends upward and is bent toward the front side. With this, a rear coupling groove 76B is formed in the upper end portion of the upper feed holder 76 having an opening that faces the front side. The rear-side coupling shaft 58R provided to the upper feed leg 56 described above is fitted into the rear coupling groove 76B. Furthermore, a front coupling groove 76C is formed in the upper end portion of the upper feed holder 76 such that it is positioned on the front side of the rear coupling groove 76B. The front coupling groove 76C is configured such that it passes through in the left-right direction. In a side view, the front coupling groove 76C is configured in an approximately U-shaped structure having an opening that faces the upper side. With such an arrangement, the front-side coupling shaft 58F provided to the upper feed leg 56 described above is fitted into the front coupling groove 76C. With this, the upper feed holder is detachably mounted on the upper feed leg 56 (feed driving mechanism unit 51).

Furthermore, a protrusion 76D is formed in the upper end portion of the upper feed holder 76 such that it is positioned on the rear side of the front coupling groove 76C and such that it protrudes upward. It should be noted that the upper feed holder 76 is supported by a support member (not shown) provided within the presser holder 72 such that it can be swung.

In a plan view, the upper feed dog 77 is configured in an approximately U-shaped block structure having an opening that faces the front side, which corresponds to the lower feed dog 35. With such an arrangement, an intermediate portion of the upper feed dog 77 defined in the left-right direction is coupled to the lower end portion of the upper feed holder 76 by a coupling pin 78 arranged with the left-right direction as its axial direction. Furthermore, a tooth portion is formed in the lower face of the upper feed dog 77, which corresponds to the first tooth portion 35A and the second tooth portion 35B of the lower feed dog 35. With this, in the feeding operation of the upper feed dog 77, a cloth is fed in a state in which the cloth is held such that it is interposed in the upper-lower direction between the second tooth portion 35B of the lower feed dog 35 and the upper feed dog 77.

With this arrangement, as described above, the presser unit 70 is detachably mounted on the presser bar 21 and the upper feed leg 56. With this arrangement, the sewing machine 10 allows the user to replace and mount various kinds of presser units. As an example, the sewing machine 10 is configured to allow the user to mount a replacement presser unit 110. Description will be made below regarding the replacement presser unit 110.

Figure 5:
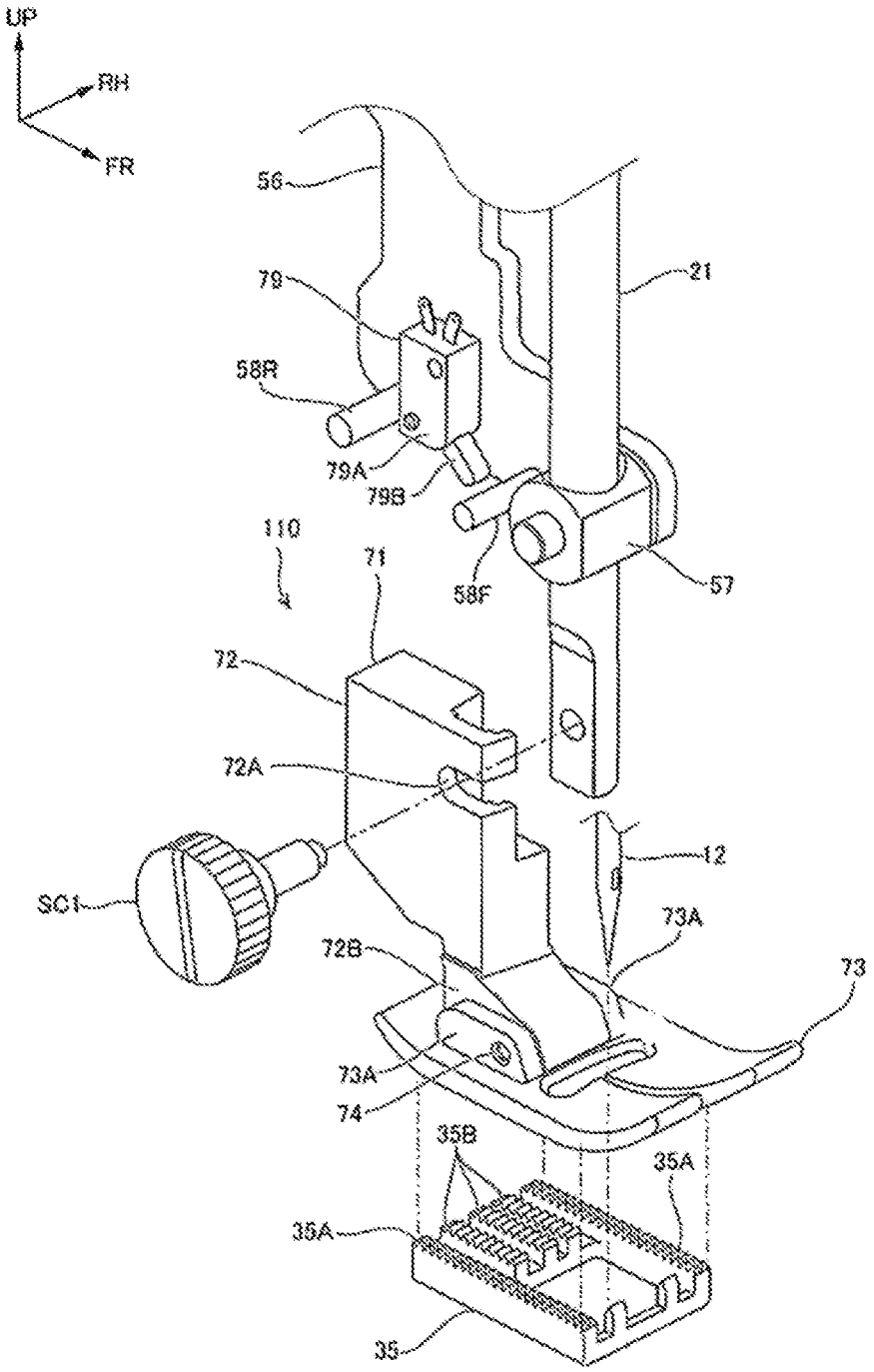
FIG. 5 is a perspective view showing a replacement presser unit configured such that it can be detachably mounted on the sewing machine shown in FIG. 1.

As shown in FIG. 5, the replacement presser unit 110 has the same configuration as the presser unit 70 except for the following points. It should be noted that, in FIG. 5, the members having the same configurations as those of the presser unit 70 are denoted by the same reference numerals. That is to say, in the replacement presser unit 110, the upper feed dog unit 75 described in the present embodiment is omitted. In other words, the replacement presser unit 110 is configured including only the presser main body 71 (the upper feed holder 76 and the presser 73) configured to press a cloth from above.

As shown in FIGS. 4 and 5, the sewing machine 10 includes a presser detection sensor 79 that detects a presser unit thus mounted. The presser detection sensor 79 is arranged at the lower end portion of the upper feed leg 56 such that it is positioned between the coupling shafts 58R and 58F. The presser detection sensor 79 is configured as a lever-type sensor. Specifically, the presser detection sensor 79 is configured including a sensor main body 79A and a lever portion 79 configured such that it extends downward from the sensor main body 79A. The lever portion 79B is rotatably coupled to the sensor main body 79A with the left-right direction as its axial direction.

Furthermore, the presser detection sensor 79 is electrically connected to the control unit 90 described later (see FIG. 2). Furthermore, the presser detection sensor 79 is configured such that, upon rotating the lever portion 79B, a detection signal (on signal) is output to the control unit 90. Specifically, in a state in which the replacement presser unit 110 is mounted on the sewing machine 10, the lever portion 89B is not pressed. In this state, the presser detection sensor 79 outputs an off signal to the control unit 90. On the other hand, when the presser unit 70 is mounted on the sewing machine 10, the lever portion 79B is pressed by the protrusion 76D of the presser unit 70, which rotates the lever portion 79B by a rotation angle of θ1 from the initial position (see FIG. 4A). In this state, the presser detection sensor 79 outputs an on signal to the control unit 90.

[Regarding the Switching Mechanism 80]

The switching mechanism 80 is configured as a component of the upper feed mechanism 50 described above. As shown in FIGS. 6 and 7, the switching mechanism 80 is configured including a stop cam 81, a slide member 82 configured as a "switching member", a switching gear 84, and a switching motor 85.

[Regarding the Stop Cam 81]

The stop cam 81 is configured as a circular plate cam with the left-right direction as its thickness direction. The stop cam 81 is provided to the upper shaft 26 such that they can be rotated together as a single unit. The stop cam 81 is arranged adjacent to the right side of the driving cam 52. It should be noted that, in the present embodiment, the stop cam 81 and the driving cam 52 are integrally formed. The stop cam 81 is configured to have an outer circumferential face that functions as a cam face. Furthermore, the stop cam 81 and the upper shaft 26 are coaxially arranged. That is to say, the stop cam 81 is set such that the distance between the axis of the upper shaft 26 and the cam face of the stop cam 81 is maintained at a constant value. Furthermore, the distance between the axis of the upper shaft 26 and the cam face of the stop cam 81 matches the minimum distance between the axis of the upper shaft 26 and the cam face of the driving cam 52.

[Regarding the Slide Member 82]

The slide member 82 is configured in an approximately longitudinal plate shape with the front-rear direction as its thickness direction and with the left-right direction as its longitudinal direction. Multiple (three in the present embodiment) slide holes 82A are each formed in the slide member 82 in the form of a long through hole with the left-right direction as its longitudinal direction. Furthermore, a mounting plate 83 is provided to the rear side of the slide member 82. The mounting plate 83 is fixed to the frame of the sewing machine 10. The mounting plate 83 is provided with bosses 83A at positions that correspond to the slide holes 82A of the slide member 82. Each boss 83A is configured in a cylindrical shape with the front-rear direction as its axial direction such that it protrudes forward from the mounting plate 83. With such an arrangement, each boss 83A is inserted into the corresponding slide hole 82A, thereby coupling the slide member 82 to the mounting plate 83 such that it can be slid in the left-right direction.

An arm coupling portion 82B configured such that it is bent forward is formed in the left end portion of the slide member 82. The arm coupling portion 82B is arranged adjacent to the upper side of the aforementioned slide arm 60A, and is coupled to a coupling protrusion 60A2 provided to the slide arm 60A. With this arrangement, upon sliding the slide member 82 in the left-right direction, the slide arm 60A is slid in the left-right direction along the axial direction of the feed upper shaft 53. Specifically, the slide arm 60A is configured such that it can be moved between a first position (position shown in FIGS. 6B and 6C) and a second position (position shown in FIGS. 7B and 7C) where it is to be moved rightward from the first position. With such an arrangement, when the slide arm 60A is set to the first position, the end portion of the arm portion 60A1 of the slide arm 60A is in contact with the cam face of the driving cam 52, which couples the slide arm 60A and the driving cam 52. On the other hand, when the slide arm 60A is set to the second position, the end portion of the arm portion 60A1 is in contact with the cam face of the stop cam 81, which couples the slide arm 60A and the stop cam 81.

A coupling shaft portion 82C is integrally provided to the right end portion of the slide member 82. The coupling shaft portion 82C is configured in a cylindrical shape with the front-rear direction as its axial direction such that it protrudes frontward from the slide member 82.

[Regarding the Switching Gear 84]

The switching gear 84 is configured in an approximately fan-plate shape with the left-right direction as its thickness direction. The switching gear 84 is arranged on the front side of the right end portion of the slide member 82. The base portion of the switching gear 84 is supported by a support shaft 83B provided to the mounting plate 83 such that it is positioned above the coupling shaft portion 82C and such that it can be rotated with the front-rear direction as its axial direction.

A gear coupling piece 84A configured such that it extends downward is integrally formed in the base portion of the switching gear 84. A coupling hole 84B is formed in the gear coupling piece 84A in the form of a slot such that it passes through. With such an arrangement, the coupling shaft portion 82C of the slide member 82 is inserted into the coupling hole 84B such that it can be relatively moved. With this, upon rotating the switching gear 84 around the axis of the support shaft 83B, the slide member 82 and the slide arm 60A are moved in the left-right direction.

An arc-shaped edge portion of the switching gear 84 is configured as a gear portion 84C. Multiple gear teeth are formed in the gear portion 84C.

[Regarding the Switching Motor 85]

The switching motor 85 is fixed to the rear face of the mounting plate 83 with the front-rear direction as its axial direction. An output shaft 85A of the switching motor 85 is arranged on the front side of the mounting plate 83 such that it is positioned on the outer side of the gear portion 84C of the switching gear 84 in the radial direction. A cylindrical motor gear 86 is fixed to the output shaft 85A of the switching motor 85. Multiple gear teeth are formed in the outer circumferential portion of the motor gear 86. With such an arrangement, the motor gear 86 and the switching gear 84 are arranged such that their gear teeth mesh with each other. With this arrangement, the switching gear 84 is rotated according to the driving of the switching motor 85.

[Regarding the Control Unit 90]

As shown in FIG. 2, the control unit 90 is electrically connected to the operating unit 13, the lever operation sensor 23, the sewing machine motor 27, the feed amount setting motor 44, the presser detection sensor 79, and the switching motor 85. With such an arrangement, the control unit 90 is configured to control the operation of the switching motor 85 based on a detection signal received from the presser detection sensor 79.

Operations and Effects

Next, description will be made regarding the operation of each of the switching mechanism 80, the lower feed mechanism 30, and the upper feed mechanism 50, and regarding the operation of the sewing machine 10 in a state in which various kinds of presser units are mounted on the presser bar 21. Furthermore, description will be made regarding the operations and the effects of the present embodiment.

[Regarding the Operation of the Switching Mechanism 80]

As shown in FIG. 6, in a state in which the slide member 82 is located at the first position, the slide arm 60A of the upper feed mechanism 50 is located at the rear side of the driving cam 52. In this state, the end portion of the arm portion 60A1 of the slide arm 60A is in contact with the cam face of the driving cam 52. This sets the transmission mechanism 60 to a transmission state in which the rotational force of the driving cam 52 is transmitted to the feed link mechanism 61. With such an arrangement, upon driving the switching motor 85 according to the control operation of the control unit 90, the motor gear 86 of the switching motor 85 is rotated in a clockwise manner, in a front view as viewed from the front side. In a front view, this rotates the switching gear 84 meshed with the motor gear 86 in a counterclockwise manner around the axis of the support shaft 83B.

Upon rotating the switching gear 84 in a counterclockwise manner around the axis of the support shaft 83B, the slide member 82 coupled to the switching gear 84 via the coupling shaft portion 82C is slid toward the right side, and is set to the second position. In this state, as shown in FIG. 7, the slide arm 60A coupled to the slide member 82 is slid rightward together with the slide member 82. With such an arrangement, in this state, the slide arm 60A is located behind the stop cam 81. In this state, the end portion of the arm portion 60A1 is in contact with the cam face of the stop cam 81. This switches the transmission mechanism 60 to the non-transmission state in which the rotational force applied by the driving cam 52 is not transmitted to the feed link mechanism 61. In other words, the driving force transmission path from the upper shaft 26 to the upper feed mechanism 50 is switched by the switching mechanism 80 from the driving cam 52 to the stop cam 81.

It should be noted that, in a state in which the slide member 82 is set to the second position, upon rotating the motor gear 86 of the switching motor 85 in a counterclockwise manner in a front view according to the control operation of the control unit 90, the slide member is set to the first position. With this, the transmission mechanism 60 is switched from the non-transmission state to the transmission state.

[Regarding the Operation of the Lower Feed Mechanism 30]

When the lower feed mechanism 30 is operated, the upper shaft 26 is rotated according to the driving of the sewing machine motor 27. Furthermore, the lower shaft 31 is rotated together with the rotation of the upper shaft 26. This operates the lower feed mechanism 30. In this operation, the lower feed dog 35 feeds a cloth toward the rear side while being displaced rearward in a state in which it protrudes upward from the needle plate 11. Specifically, in a feeding state in which the needle 12 is set to a position above the needle plate 11, the upper end of the lower feed dog 35 is raised to a position that matches the upper face of the needle plate 11, and the feeding operation of the lower feed dog 35 is started for the cloth. Subsequently, the lower feed dog 35 is further raised and is displaced rearward. In this stage, the upper end of the lower feed dog 35 is raised such that it protrudes from the upper face of the needle plate 11 so as to feed the cloth toward the rear side. Subsequently, the upper end of the lower feed dog 35 is lowered to a position that is approximately the same as the upper face of the needle plate 11, thereby ending the feeding operation of the lower feed dog 35 for the cloth. On the other hand, when the needle 12 is located below the needle plate 11 in the stitching pattern forming state, the lower feed dog 35 is displaced downward such that it is lowered to a position that is below the needle plate 11. Subsequently, the lower feed dog 35 is displaced frontward, and is returned to the previous state before feeding the cloth.

[Regarding the Operation of the Upper Feed Dog 50 when the Slide Member 82 is Set to the First Position]

The feed driving mechanism unit 51 of the upper feed mechanism 50 operates in conjunction with the operation of the lower feed mechanism 30. Specifically, as shown in FIG. 8A, in the feeding state in which the needle 12 is located above the needle plate 11, the feed upper shaft 53 is rotated in a counterclockwise manner around the axis of the feed upper shaft 53 itself. In this state, the upper feed arm 54 is rotated in a counterclockwise manner with the feed upper shaft 53 as the center of rotation. Furthermore, the upper feed leg 56 is rotated with the coupling portion that couples it and the coupling body 57 as the center of rotation. As a result, the upper feed dog 77 coupled to the upper feed leg 56 via the upper feed holder 76 is displaced rearward.

In a state in which the slide arm 60A is set to the first position by the switching mechanism 80, the transmission mechanism 60 is set to the transmission state in which the rotational driving force of the driving cam 52 is transmitted to the feed link mechanism 61. With such an arrangement, in the feeding state in which the needle 12 is located above the needle plate 11, the slide arm 60A is rotated in a clockwise manner with the feed upper shaft 53 as the center of rotation according to the cam face of the driving cam 52. In this stage, the triangular link 63 is coupled to the coupling shaft 60B of the slide arm 60A via the coupling link 62, and the triangular link 63 is rotated in a counterclockwise manner with the coupling portion that couples it and the release link 64 as the center of rotation. Accordingly, the switching link 65 coupled to the triangular link 63 is displaced downward, which displaces the coupling body 57 and the upper feed leg 56 coupled to the switching link 65 downward. This displaces the upper feed dog 77 coupled to the upper feed leg 56 via the upper feed holder downward such that it directly or indirectly (via a cloth) comes in contact with the lower feed dog 35. With this, the cloth is fed toward the rear side in a state in which the cloth is interposed between the upper feed dog 77 and the lower feed dog 35.

Furthermore, when the slide arm 60A is further rotated in a clockwise manner with the feed upper shaft 53 as the center of rotation, the lower feed dog 35 is directly or indirectly in contact with the upper feed dog 77. Accordingly, in this state, the lower feed dog 35 limits the displacement of the upper feed dog 77 toward the lower side. This limits the downward displacement of the coupling body coupled to the upper feed dog 77 via the upper feed holder 76 and the upper feed leg 56 (i.e., the switching link 65). With this, the triangular link 63 is rotated in a counterclockwise manner with the coupling portion that couples it and the switching link 65 as the center of rotation, which displaces the release link 64 upward. As a result, the spring releasing mechanism 66 operates. Specifically, the spring holder 69 is lifted upward with respect to the presser bar 21 by the release link 64, thereby releasing the force applied to the presser bar 21 by the presser spring 24.

Subsequently, the contact position of the slide arm 60A with the cam face of the driving cam 52 is switched from the maximum radius portion side to the minimum radius portion side of the cam face, thereby reversing the swinging of the slide arm 60A. In this stage, the spring holder 69 is displaced downward from a position at which the force applied by the spring is released, such that it is returned to a position at which it is pressed in contact with the spring receiver 68. As a result, when the feeding operation for the cloth ends, the state is returned to a state in which the force of the presser spring 24 is applied to the presser bar 21.

Figure 8B:
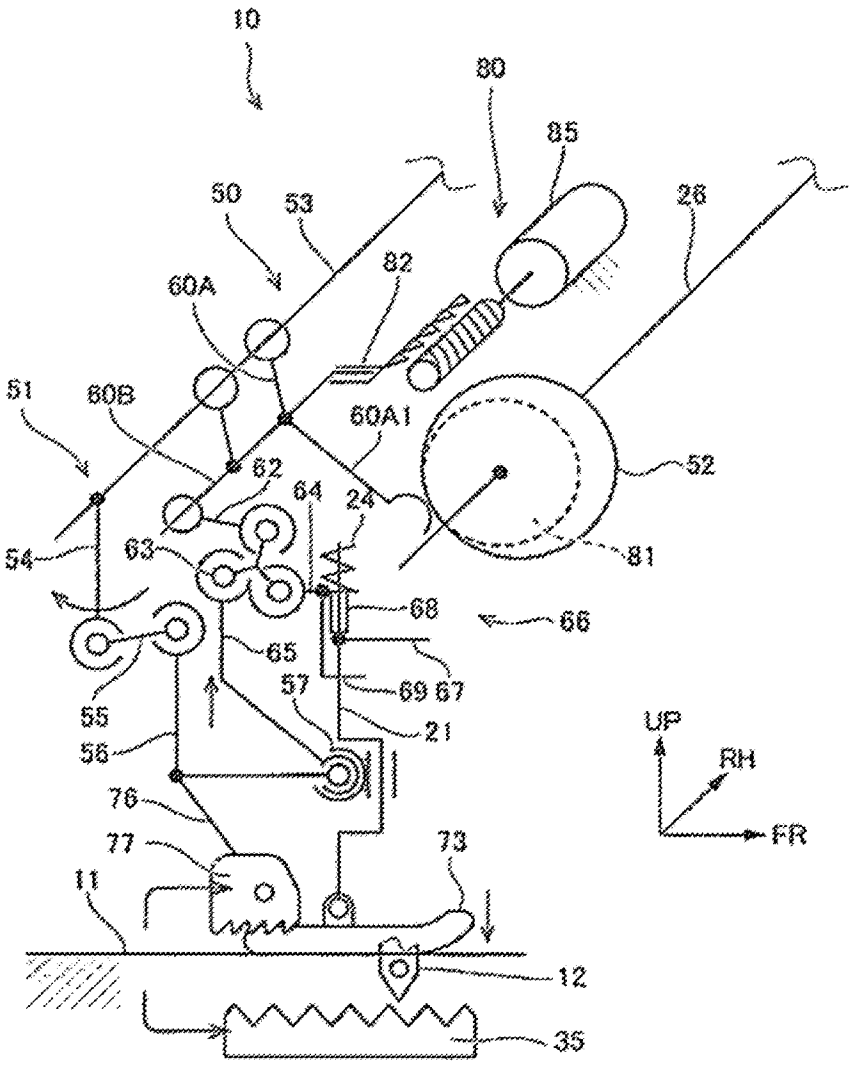
FIG. 8B is an explanatory diagram for explaining the operation of the upper feed mechanism in a stitching pattern forming state when the switching mechanism is set to the state shown in FIG. 6.
Figure 8A:
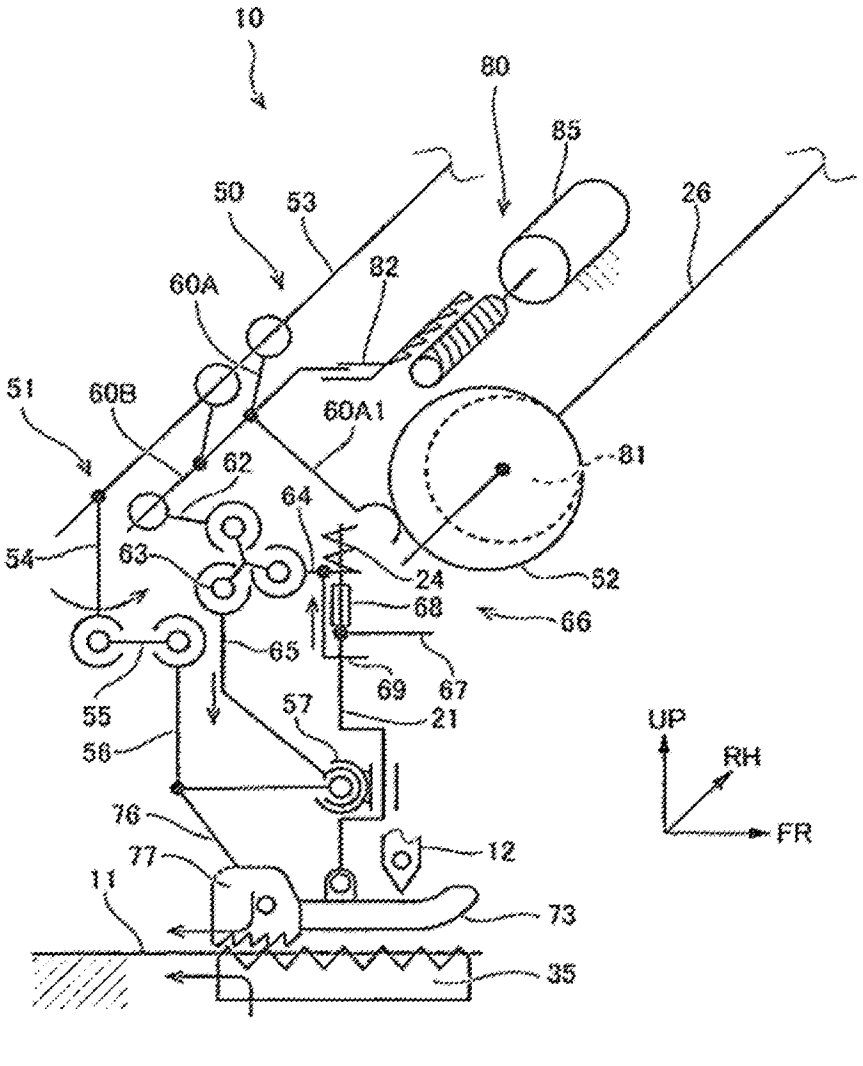
FIG. 8A is an explanatory diagram for explaining the operation of an upper feed mechanism in a feeding state when the switching mechanism is set to the state shown in FIG. 6.

On the other hand, as shown in FIG. 8B, in the stitching pattern forming state in which the needle 12 is located at a position below the needle plate 11, the feed upper shaft 53 is rotated in a clockwise manner around its own axis. With this, the upper feed arm 54 is rotated in a clockwise manner with the feed upper shaft 53 as the center of rotation. Furthermore, the upper feed leg 56 is rotated with the coupling portion that couples it and the coupling body 57 as the center of rotation. As a result, the upper feed dog 77 coupled to the upper feed leg 56 via the upper feed holder 76 is displaced frontward. It should be noted that, in the stitching pattern forming state, the lower feed dog 35 is located at a position below the needle plate 11, thereby releasing the contact state between the lower feed dog 35 and the upper feed dog 77.

Furthermore, the end portion of the arm portion 60A1 of the slide arm 60A is in contact with the driving cam 52. Accordingly, upon rotating the driving cam 52, the slide arm 60A is rotated in a counterclockwise manner with the feed upper shaft 53 as the center of rotation. With this, the triangular link 63 coupled to the slide arm 60A via the coupling link 62 is rotated in a clockwise manner with the coupling portion that couples it and the release link 64 as the center of rotation. In this state, the switching link 65 coupled to the triangular link 63 is displaced upward. Furthermore, the coupling body 57 and the upper feed leg 56 are displaced upward. Accordingly, the upper feed dog 77 coupled to the upper feed leg 56 via the upper feed holder 76 is also displaced upward, thereby raising the upper feed dog 77 so as to form a gap between the cloth and the upper feed dog 77.

As described above, when the slide member 82 is located at the first position, the upper feed dog 77 is reciprocated in the front-rear direction and in the upper-lower direction by the upper feed mechanism 50 (feed driving mechanism unit 51). This enables the upper feed dog 77 to perform the feeding operation.

[Regarding the Operation of the Upper Feed Mechanism 50 when the Slide Member 82 is Set to the Second Position]

Figure 9B:
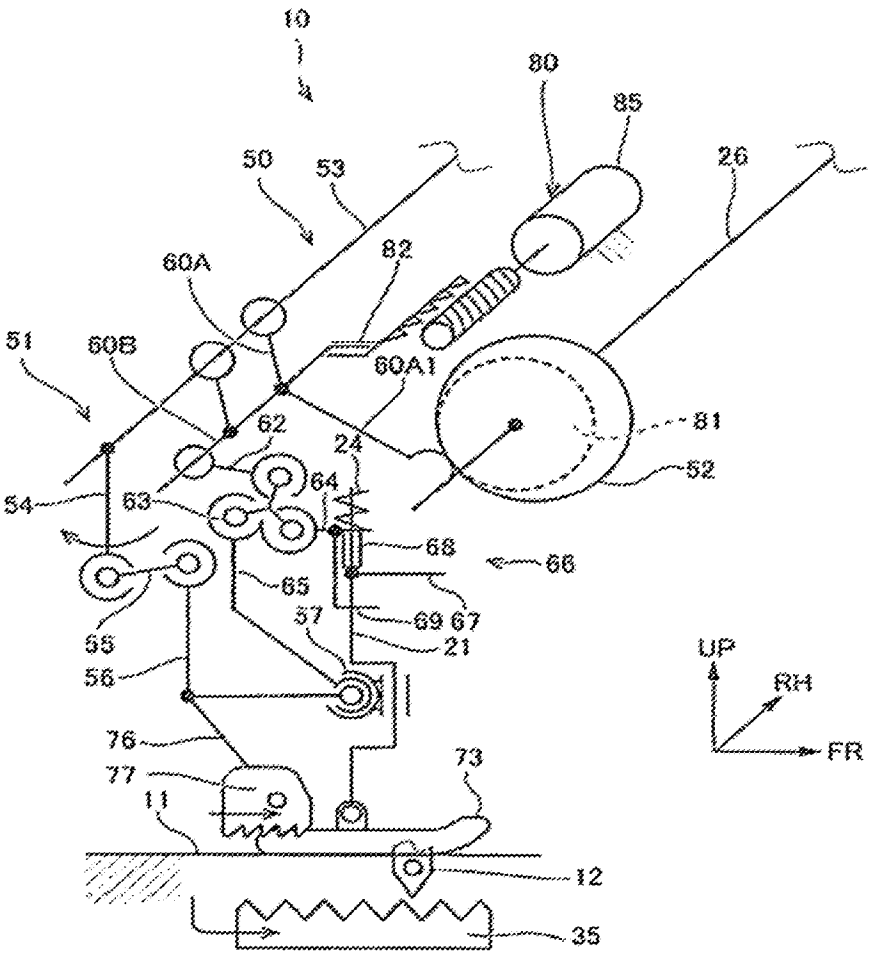
FIG. 9B is an explanatory diagram for explaining the operation of the upper feed mechanism in a stitching pattern forming state when the switching mechanism is set to the state shown in FIG. 7.
Figure 9A:
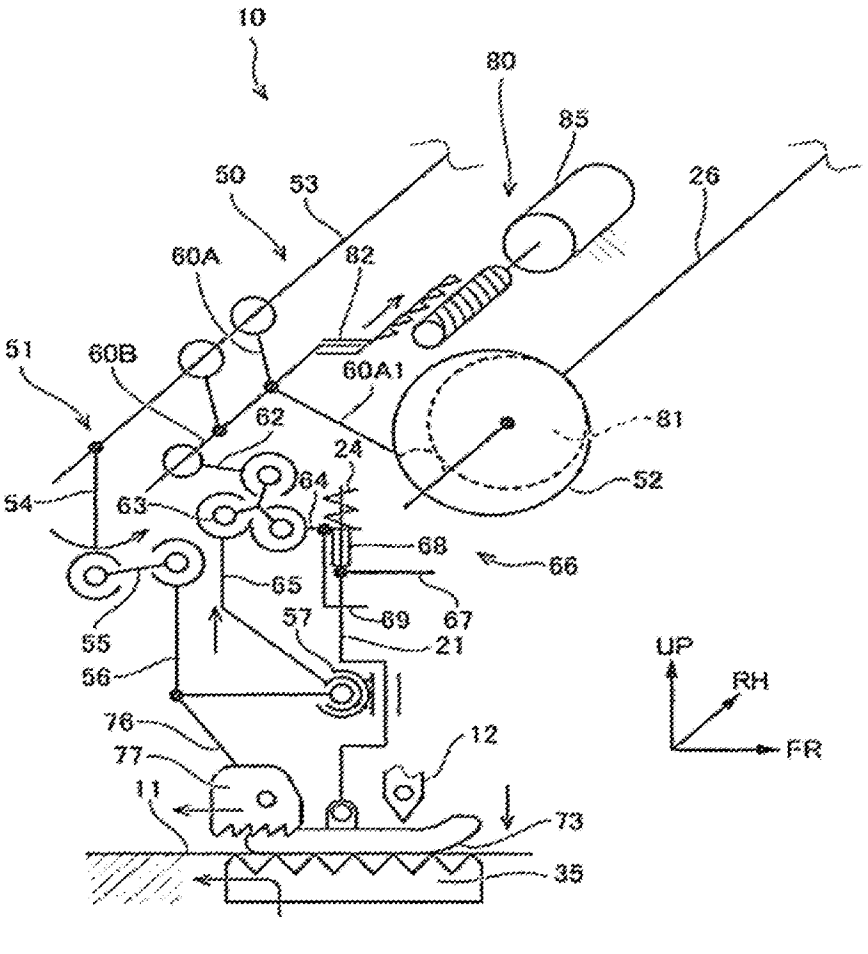
FIG. 9A is an explanatory diagram for explaining the operation of an upper feed mechanism in a feeding state when the switching mechanism is set to the state shown in FIG. 7.

As shown in FIGS. 9A and 9B, in a state in which the slide arm 60A is set to the second position by the switching mechanism 80, the transmission mechanism 60 is set to the non-transmission state in which the rotational driving force of the driving cam 52 is not transmitted to the feed link mechanism 61. With this arrangement, the stop cam 81 and the upper shaft 26 are arranged coaxially. Accordingly, the distance between the axis of the upper shaft 26 and the cam face of the stop cam 81 is maintained at a constant value. With this, when the stop cam 81 is rotated due to the rotation of the upper shaft 26, this does not swing the slide arm 60A. Accordingly, in the non-transmission state of the transmission mechanism 60, the feed link mechanism 61 does not operate, thereby suspending the reciprocation of the upper feed dog 77 in the upper-lower direction. That is to say, the upper feed mechanism 50 is set to a state in which the driving of the upper feed dog 77 in the upper-lower direction is suspended. In other words, the upper feed mechanism 50 is set to a state in which the feeding operation of the upper feed dog 77 is suspended.

Furthermore, the distance between the axis of the upper shaft 26 and the cam face of the stop cam 81 matches the minimum distance between the axis of the upper shaft 26 and the cam face of the driving cam 52. Accordingly, the upper feed dog 77 is located at a position above the lower feed dog 35 with a gap between them. Specifically, the upper feed dog 77 is located at a position at which it is not in contact with the lower feed dog 35 in the feeding operation. In this state, the operation of the spring releasing mechanism 66 is suspended. That is to say, regardless of whether the sewing machine 10 is set to the stitching pattern forming state or the feeding state, the pressure is applied to a cloth from the presser 73. With this, the cloth is fed toward the rear side in a state in which the cloth is interposed between the lower feed dog 35 and the presser 73. It should be noted that, in this state, the upper feed dog 77 reciprocates in the front-rear direction at a position such that it does not come in contact with the lower feed dog 35 in the feeding operation.

[Regarding the Operation of the Sewing Machine 10 in a State in which Various Kinds of Presser Units are Mounted on the Presser Bar 21]

Figure 10:
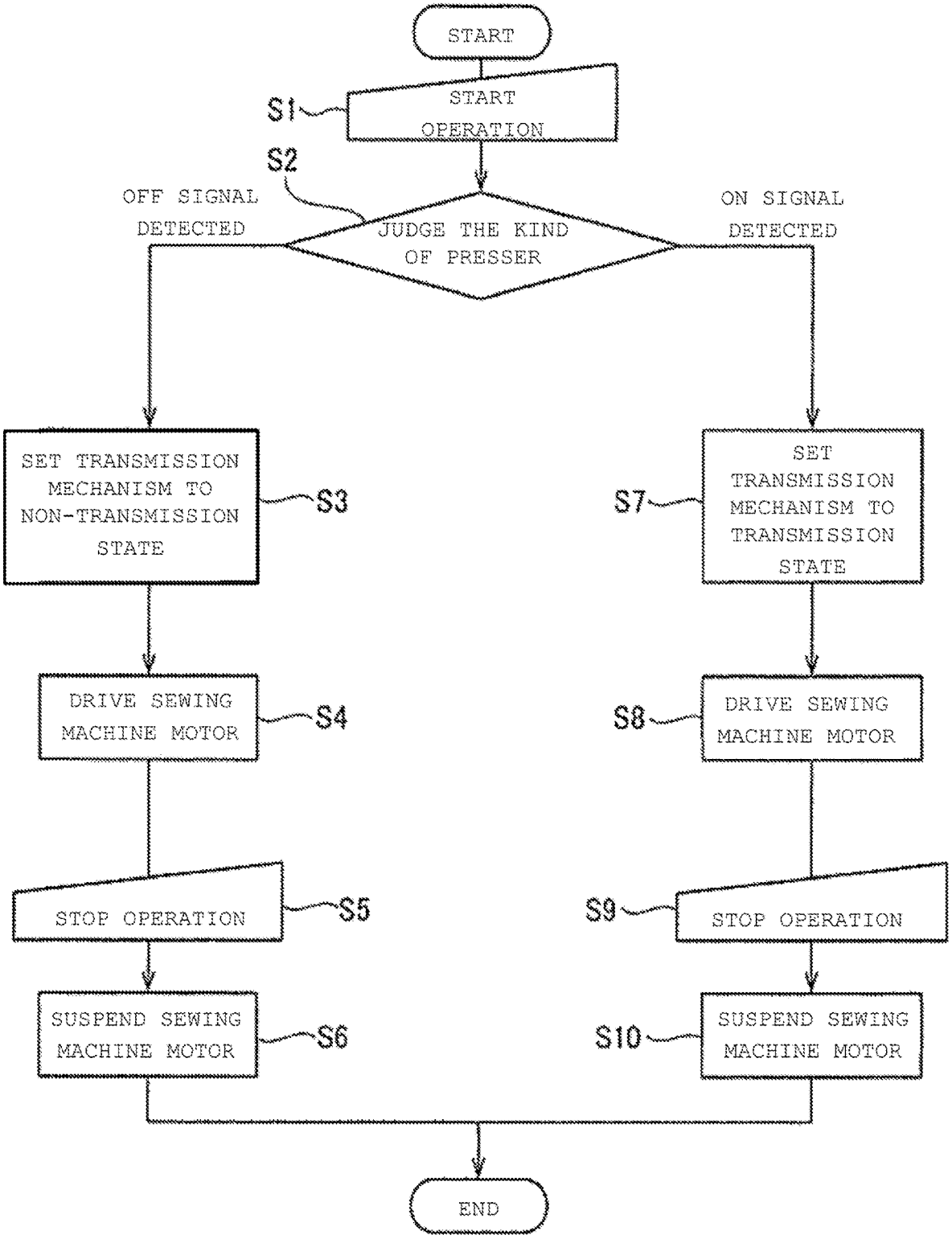
FIG. 10 is a flowchart for explaining the operation of the sewing machine according to the first embodiment.

Next, description will be made with reference to a flowchart shown in FIG. 10 regarding the operation of the sewing machine 10 in a state in which various kinds of presser units are mounted on the presser bar 21. It should be noted that description will be made below assuming that, before the sewing machine 10 is operated, the slide member of the switching mechanism 80 is set to the first position. That is to say, the transmission mechanism 60 is set to the transmission state in which the transmission mechanism 60 transmits the rotational driving force of the driving cam 52 to the feed link mechanism 61.

First, in Step S1, when the user performs a start operation using the operating button 14 of the sewing machine 10, the operation of the sewing machine 10 is started.

Subsequently, after the execution of Step S1, the flow transits to Step S2. In Step S2, the control unit 90 judges the kind of the presser mounted on the presser bar 21 based on the detection signal received from the presser detection sensor 79. When judgment is made in Step S2 that the replacement presser unit 110 is mounted on the presser bar (when an "off signal" has been detected in Step S2), the flow transits to Step S3.

In Step S3, the switching mechanism 80 sets the transmission mechanism 60 to the non-transmission state. In this stage, the slide member 82 is set to the first position. Accordingly, the transmission mechanism 60 is set to the transmission state. Accordingly, the switching motor 85 of the switching mechanism 80 operates according to the control operation of the control unit 90, so as to slide the slide member 82 from the first position to the second position. This switches the transmission mechanism 60 to the non-transmission state. After the execution of Step S3, the flow transits to Step S4.

In Step S4, the sewing machine motor 27 is driven according to the control operation of the control unit 90, thereby staring sewing for a cloth. That is to say, the needle mechanism is driven by the rotation of the upper shaft 26, thereby reciprocating the needle 12 in the upper-lower direction. This provides the formation of a stitching pattern in the cloth. Furthermore, in this stage, the lower feed mechanism 30 is driven by the rotation of the upper shaft 26, thereby operating the lower feed dog 35 such that it draws an elliptical trajectory in a side view.

Subsequently, after the execution of Step S4, the flow transits to Step S5. In Step S5, when the user performs a stop operation using the operating button 14 of the sewing machine 10, the flow transits to Step S6. In Step S6, the driving of the sewing machine motor 27 is suspended. After the driving operation of the sewing machine motor 27 is suspended, the processing ends.

As described above, when the replacement presser unit 110 including no upper feed dog 77 is mounted on the presser bar 21, the transmission mechanism 60 is set to the non-transmission state in which the operation of the transmission link mechanism 61 is suspended. In this state, sewing is performed for the cloth.

On the other hand, when judgment is made in Step S2 that the presser unit 70 is mounted on the presser bar 21 (when the "on signal" is detected in Step S2), the flow transits to Step S7.

In Step S7, the switching mechanism 80 switches the transmission mechanism 60 to the transmission state. In this stage, the slide member 82 is set to the first position. Accordingly, in this stage, the transmission mechanism 60 is in the transmission state. Accordingly, the switching motor of the switching mechanism 80 does not operate, which maintains the state in which the slide member 82 is set to the first position. This maintains the transmission state of the transmission mechanism 60. Subsequently, after the execution of Step S7, the flow transits to Step S8.

In Step S8, the same processing as in Step S4 is executed. That is to say, the sewing machine motor 27 is driven by the control operation of the control unit 90, thereby starting the sewing for the cloth.

Subsequently, after the execution of Step S8, the flow transits to Step S9. In Step S9, when the user performs a stop operation using the operating button 14 of the sewing machine 10, the flow transits to Step S10. Subsequently, in Step S10, the driving operation of the sewing machine motor 27 is suspended by the control operation of the control unit 90. After the driving operation of the sewing machine motor 27 is suspended, the processing ends.

As described above, when the presser unit 70 including the upper feed dog 77 is mounted on the presser bar 21, the transmission mechanism 60 is set to the transmission state in which the operation of the transmission link mechanism 61 is enabled. In this state, sewing for a cloth is performed. That is to say, sewing is performed for a cloth in a state in which the feeding operation of the normal upper feed dog 101 is enabled.

It should be noted, in the operation of the sewing machine 10 described above, the switching mechanism 80 is automatically operated by the control operation of the control unit 90. Also, such an arrangement allows the user to operate the operating unit 13 so as to operate the switching mechanism 80. For example, in a state in which the presser unit 70 is mounted on the presser bar 21, and the feeding operation of the upper feed dog 77 is permitted, such an arrangement allows the user to operate the operating unit 13 so as to operate the switching mechanism 80 in order to suspend the feeding operation of the upper feed dog 77. With this, when there is no need to perform the feeding operation of the upper feed dog 77, such an arrangement allows the user to suspend the feeding operation of the upper feed dog 77.

As described above, with the sewing machine 10 according to the present embodiment, the switching mechanism is coupled to the slide arm 60A of the transmission mechanism 60 included in the upper feed mechanism 50. With such an arrangement, when the switching mechanism 80 is operated, the slide arm 60A is set to the transmission state in which the driving force of the driving cam 52 is transmitted to the feed link mechanism 61 or otherwise the non-transmission state in which the driving force of the driving cam 52 is not transmitted to the link mechanism 61. Accordingly, by switching the slide arm 60A to the non-transmission state by the switching mechanism 80, this arrangement allows the operation of the feed link mechanism 61 to be suspended, and allows the driving operation of the upper feed dog 77 in the upper-lower direction to be suspended. Accordingly, for example, when the replacement presser unit 110 having no upper feed dog 77 is mounted on the presser bar 21, the slide arm 60A is set to the non-transmission state, thereby allowing the operation of the feed link mechanism 61 to be suspended. Furthermore, for example, even when the presser unit 70 having the upper feed dog 77 is mounted on the presser bar 21, this arrangement allows the slide arm 60A to be set to the non-transmission state, thereby allowing the operation of the feed link mechanism 61 to be suspended. Accordingly, this arrangement is capable of contributing to the reduction of vibration and noise in the sewing machine 10.

Furthermore, in the non-transmission state of the transmission mechanism 60 (slide arm 60A), the upper feed dog 77 is located at a position above the presser 73. This allows the driving operation of the upper feed dog 77 in the upper-lower direction to be suspended in a state in which the presser unit 70 is mounted on the presser bar 21. With this, for example, when the upper feed dog 77 is not used, there is no need to detach the presser unit 70 from the presser bar 21, and to mount the replacement presser unit 110 on the presser bar 21, in order to reduce vibration or noise that occurs due to the diving operation of the upper feed dog 77 in the upper-lower direction. Accordingly, this provides improved convenience for the user.

Furthermore, the switching mechanism 80 is configured including: the stop cam 81 provided to the upper shaft 26 such that they can be rotated as a single unit; and the slide member 82 coupled to the slide arm 60A. With such an arrangement, when the slide member 82 is operated according to the driving operation of the switching motor 85, the slide arm 60A is moved along the axial direction of the feed upper shaft 53, and is coupled to the driving cam 52 or the stop cam 81. When the slide arm 60A is coupled to the stop cam 81, the swinging of the slide arm 60A is suspended, which suspends the movement of the upper feed dog 77 in the upper-lower direction. With this, by designing the radius of the stop cam 81 as appropriate, this arrangement allows the upper feed dog 77 to be set to a position such that it does not come in contact with the lower feed dog 35, thereby allowing the operation of the spring releasing mechanism 66 to be suspended.

Description has been made in the present embodiment regarding an arrangement in which the presser detection sensor 79 is mounted at the lower end portion of the upper feed leg 56. The presser detection sensor 79 is configured to detect the kind of the presser unit mounted on the presser bar 21. Accordingly, for example, when the replacement presser unit 110 including no upper feed dog 77 is mounted on the presser bar 21, such an arrangement is capable of operating the switching mechanism 80 by the control operation of the control unit 90 so as to automatically suspend the operation of the feed link mechanism 61. This effectively provides improved convenience for the user.

Second Embodiment

Figure 11:
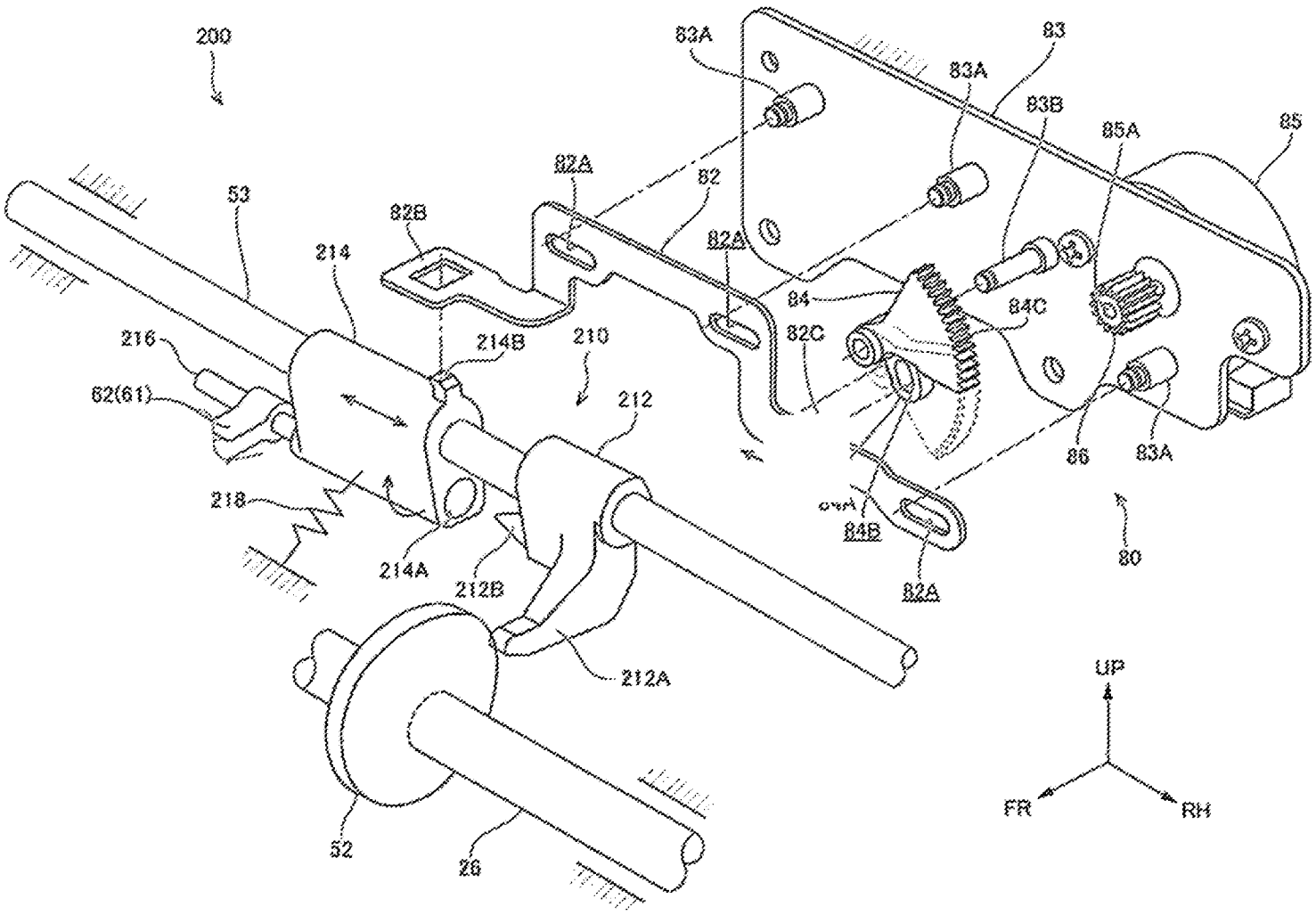
FIG. 11 is a perspective view showing a transmission mechanism and a switching mechanism included in a sewing machine according to a second embodiment as viewed diagonally from the right front side.

Description will be made with reference to FIG. 11 regarding a sewing machine 200 according to a second embodiment. The sewing machine 200 according to the second embodiment has the same configuration as that of the sewing machine 10 according to the first embodiment except for the points of difference described below. It should be noted that the members having the same configurations as those of the sewing machine 10 according to the first embodiment are denoted by the same reference numerals.

That is to say, in the sewing machine 200, the stop cam 81 is omitted from the switching mechanism 80. Furthermore, in the sewing machine 200, the upper feed mechanism 50 includes a transmission mechanism 210 instead of the transmission mechanism 60 according to the first embodiment.

The transmission mechanism 210 is configured including a transmission arm 212 configured as a "first transmission member" and a coupling slide arm 214 configured as a "second transmission member".

The transmission arm 212 is configured in an approximately rectangular block shape and is arranged on the rear side of the driving cam 52 such that it extends in the upper-lower direction. Furthermore, the upper end portion of the transmission arm 212 is supported by the feed upper shaft 53 such that it can be swung. An arm portion 212A is formed in the lower end portion of the transmission arm 212 such that it extends toward the front side. Furthermore, the transmission arm 212 is forced toward the front side (driving cam 52 side) by an unshown force-applying spring. In this state, the end portion of the arm portion 212A is pressed in contact with the cam face of the driving cam 52. With this, the transmission arm 212 is coupled to the driving cam 52. When the driving cam 52 is rotated, the transmission arm 212 is configured to swing around the axis of the feed upper shaft 53 according to the shape of the cam face.

A transmission pin 212B is integrally formed at an intermediate portion of the transmission arm 212 in the longitudinal direction. The transmission pin 212B is configured such that it protrudes leftward from the transmission arm 212 with the left-right direction as its axial direction. Furthermore, the transmission pin 212B is configured to have a diameter designed that becomes smaller as it approaches the end side. That is to say, the transmission pin 212B is configured in a circular cone shape.

The coupling slide arm 214 is configured in an approximately longitudinal block shape with the left-right direction as its longitudinal direction. The coupling slide arm 214 is arranged on the left side of the transmission arm 212. The upper end portion of the slide arm 214 is supported by the feed upper shaft 53 such that it can be swung. Furthermore, the coupling slide arm 214 is configured such that it can be relatively moved with respect to the feed upper shaft 53 in the axial direction of the feed upper shaft 53.

A coupling recess portion 214A is formed in the right-side face of the coupling slide arm 214. The coupling recess portion 214A is configured as a recess having an opening that faces the right side. The coupling recess portion 214A is configured in a circular shape as viewed from the right side. With such an arrangement, the transmission pin 212B of the transmission arm 212 is configured such that it can be inserted into the coupling recess portion 214A. Furthermore, a coupling shaft 216 is provided to the lower end portion of the coupling slide arm 214 such that it protrudes toward the left side. The coupling link 62 of the feed link mechanism 61 is rotatably coupled to the coupling shaft 216. It should be noted that the distance between the axis of the feed upper shaft 53 and the axis of the coupling shaft 216 is designed to be the same as the distance between the axis of the feed upper shaft 53 and the coupling shaft 60B according to the first embodiment.

Furthermore, a coupling protrusion 214B configured such that it protrudes upward is formed in the upper end portion of the coupling slide arm 214. The coupling protrusion 214B is coupled to the arm coupling portion 82B of the slide member 82 included in the switching mechanism 80. With this, upon sliding the slide member 82 of the switching mechanism 80 in the left-right direction, the coupling slide arm 214 is configured such that it is moved in the left-right direction along the axial direction of the feed upper shaft 53. It should be noted that there is a left-right reversal relation with respect to the first position and the second position between the first embodiment and the second embodiment.

Specifically, when the slide member 82 is set to the first position, the coupling slide arm 214 is set such that it is positioned adjacent to the left side of the transmission arm 212. In this state, the transmission pin 212B of the transmission arm 212 is inserted into the coupling recess portion 214A of the coupling slide arm 214. In this state, the transmission pin 212B is engaged with the coupling recess portion 214A such that the coupling slide arm 214 and the transmission arm 212 can be swung as a single unit. This sets the transmission mechanism 210 to the transmission state. With such an arrangement, when the transmission mechanism 210 is set to the transmission state, the rotational driving of the upper shaft 26 (driving cam 52) is transmitted to the feed link mechanism 61 by the transmission mechanism 210, thereby operating the feed link mechanism 61 (not shown).

On the other hand, when the slide member 82 is slid from the first position toward the left side such that it is set to the second position, the coupling slide arm 214 is moved away from the transmission arm 212 so as to release the engagement state between the transmission pin 212B of the transmission arm 212 and the coupling recess portion 214A of the coupling slide arm 214. This sets the transmission mechanism 210 to the non-transmission state. With such an arrangement, when the transmission mechanism 210 is set to the non-transmission state, the swinging of the coupling slide arm 212 is not transmitted to the coupling slide arm 214, thereby suspending the swinging of the coupling slide arm 214. In this state, the rotational driving of the upper shaft 26 (driving cam 52) is not transmitted to the feed link mechanism 61, thereby suspending the operation of the feed link mechanism 61 (not shown).

Furthermore, an arm force-applying spring 218 is provided on the front side of the coupling slide arm 214. One end portion of the arm force-applying spring 218 is engaged with the lower end portion of the coupling slide arm 214. The other end portion of the arm force-applying spring 218 is engaged with the frame of the sewing machine 200. The coupling slide arm 214 is forced toward the front side by the arm force-applying spring 218. With this, in a state in which the slide member 82 is set to the second position, the coupling slide arm 214 is turned in a counterclockwise manner as viewed from the left side. Specifically, the coupling slide arm 214 is turned such that the coupling shaft 216 is set to the same position as that of the coupling shaft 60B when the slide arm 60A is set such that it comes in contact with the cam face of the stop cam 81 in the first embodiment. Accordingly, when the slide member 82 is set to the second position, as in the first embodiment, the upper feed dog 77 is set above the lower feed dog 35 with a gap between them, and the feeding operation of the upper feed dog 77 is suspended. Specifically, the upper feed dog 77 is set such that it is not in contact with the lower feed dog 35 that performs the feeding operation.

Furthermore, when the slide member 82 is set to the second position, the transmission pin 212B of the transmission arm 212 is set such that its end portion is positioned within the opening of the coupling recess portion 214A of the coupling slide arm 214. Accordingly, when the slide member 82 is slid toward the right side from the second position, the inner circumferential face of the coupling recess portion 214A of the coupling slide arm 214 comes in contact with the outer circumferential face of the transmission pin 212B. Furthermore, the coupling slide arm 214 is turned around the axis of the feed upper shaft 53 such that it approaches the transmission arm 212. Accordingly, when the slide member 82 is set to the first position, the transmission pin 212B is inserted again into and coupled with the coupling recess portion 214A of the coupling slide arm 214.

With the sewing machine 200 according to the second embodiment, the transmission mechanism 210 is switched by the switching mechanism 80 between the transmission state and the non-transmission state. With such an arrangement, when the slide member 82 of the switching mechanism 80 is set to the second position, the transmission mechanism 210 is set to the non-transmission state, thereby allowing the operation of the feed link mechanism 61 of the upper feed mechanism 50 to be suspended. This allows the feeding operation of the upper feed dog 77 of the presser unit 70 mounted on the presser bar 21 to be suspended. As described above, the second embodiment provides the same operations and effects as those provided by the first embodiment.

Modifications

It should be noted that, with the sewing machine 10 according to the first embodiment or the sewing machine 200 according to the second embodiment, when the transmission mechanism 60 or 210 is set to the non-transmission state by the switching mechanism 80, the driving operation of the upper feed dog 77 in the upper-lower direction is suspended. In addition, the sewing machine 10 or 200 may be provided with a known feeding stop mechanism configured to suspend the driving operation of the upper feed dog 77 in the front-rear direction. This further contributes to reduction of vibration and noise in the sewing machine 10 or 200.

Description has been made in the first and second embodiments regarding an arrangement in which the presser units 70 and 110 are each configured such that it is detachably mounted on the upper feed mechanism 50. However, the present invention is not restricted to such a detachable structure. Also, for example, it is anticipated that the present invention is effectively applicable to an arrangement in which, instead of such a detachable structure, a part of the upper feed mechanism 50 such as the upper feed leg 56 or the like has a foldable structure or an extendable structure in which, when the upper feed mechanism is not operated, a part of the upper feed mechanism 50 is housed within the sewing machine. Also, it is anticipated that the present invention is effectively applicable to an upper feed mechanism having no detachable structure, no foldable structure, and no extendable structure.

It should be noted that the present invention also includes various kinds of combinations of all of or a part of the first and second embodiments and the above-described modifications. Also, various kinds of omissions, substitutions, or changes may be made without departing from the technical scope of the present invention. Also, various modifications thereof are included in the present invention.

DESCRIPTION OF THE REFERENCE NUMERALS

10 sewing machine, 10A bed portion, 10B leg portion, 10C arm portion, 11 needle plate, 12 needle, 13 operating unit, 14 operating button, 20 presser mechanism, 21 presser bar, 22 operating lever, 23 lever operation sensor, 24 presser spring, 25 driving mechanism, 26 upper shaft, 27 sewing machine motor, 28 motor belt, 30 lower feed mechanism, 31 lower shaft, 32 coupling belt, 33 first lower feed cam, 34 second lower feed cam, 35 lower feed dog, 35A first feed dog portion, 35B second feed dog portion, 36 feed base, 37 feed lower shaft, 38 first lower feed arm, 39 second lower feed arm, 40 third lower feed arm, 41 forked link, 42 feed setting device, 42A groove portion, 43 angular piece, 44 feed amount setting motor, 45 coupling link mechanism, 50 upper feed mechanism, 51 feed driving mechanism unit, 52 driving cam, 53 feed upper shaft, 54 upper feed arm, 55 feed link, 56 upper feed leg, 57 coupling body, 58R coupling shaft, 58F coupling shaft, 60 transmission mechanism, 60A slide arm (slide transmission member), 60A1 arm portion, 60A2 coupling protrusion, 60B coupling shaft, 61 feed link mechanism (link mechanism), 62 coupling link, 63 triangular link, 64 release link, 65 switching link, 66 spring releasing mechanism, 67 presser bar holder, 68 spring receiver, 69 spring holder, 70 presser unit, 71 presser main body, 72 presser holder, 72A fixing groove, 72B presser mount portion, 73 presser, 73A mount wall, 74 mount pin, 75 upper feed dog unit, 76 upper feed holder, 76A coupling piece, 76B rear coupling groove, 76C front coupling groove, 76D protrusion, 77 upper feed dog, 78 coupling pin, 79 presser detection sensor, 79A sensor main body, 79B lever portion, 80 switching mechanism, 81 stop cam, 82 slide member (switching member), 82A slide hole, 82B arm coupling portion, 82C coupling shaft portion, 83 mounting plate, 83A boss, 83B support shaft, 84 switching gear, 84A gear coupling piece, 84B coupling hole, 84C gear portion, 85 switching motor, 85A output shaft, 86 motor gear, 90 control unit, 110 replacement presser unit, 200 sewing machine, 210 transmission mechanism, 212 transmission arm (first transmission member), 212A arm portion, 212B transmission pin, 214 coupling slide arm (second transmission member), 214A coupling recess portion, 214B coupling protrusion, 216 coupling shaft, 218 arm force-applying spring, SC1 fixing screw.

What is claimed is:

1. A sewing machine comprising an upper feed mechanism configured to cause an upper feed dog provided to an upper side of a needle plate to perform a feeding operation, wherein the upper feed mechanism comprises:

a driving cam provided to an upper shaft such that they can be rotated as a single unit;

a link mechanism configured to operate when receiving a transmission of a driving force of the driving cam;

a transmission mechanism configured to transmit a driving force of the driving cam to the link mechanism so as to operate the link mechanism;

an upper feed leg mounting the upper feed dog, and coupled to the link mechanism such that, when the link mechanism is operated, the upper feed dog is driven in an upper-lower direction; and a switching mechanism configured to switch the transmission mechanism between a transmission state in which the driving force of the driving cam is transmitted to the link mechanism and a non-transmission state in which the driving force of the driving cam is not transmitted to the link mechanism, and wherein the switching mechanism switches the transmission mechanism to the non-transmission state so as to suspend an upper-lower movement of the upper feed leg.

2. The sewing machine according to claim 1, wherein, when the transmission mechanism is set to the non-transmission state, the upper feed dog is set to a stationary state above a presser configured to press a sewing target.

3. The sewing machine according to claim 1, wherein the transmission mechanism comprises a slide transmission member, and wherein the slide transmission member is provided to a feed upper shaft arranged in parallel with the upper shaft such that it can be swung and such that it can be moved in an axial direction of the feed upper shaft.

4. The sewing machine according to claim 3, wherein the switching mechanism comprises:

a stop cam provided to the upper shaft such that the stop cam and the upper shaft can be rotated as a single unit; and a switching member coupled to the slide transmission member, and configured to operate so as to move the slide transmission member in the axial direction of the feed upper shaft in order to switch a position thereof between a first position at which the slide transmission member is coupled to the driving cam and a second position at which the slide transmission member is coupled to the stop cam, and wherein the switching mechanism is operated so as to switch the first position to the second position in order to suspend a swinging of the slide transmission member coupled to the stop cam, thereby setting the transmission mechanism to the non-transmission state.

5. The sewing machine according to claim 1, wherein the transmission mechanism comprises:

a first transmission member provided to a feed upper shaft arranged in parallel with the upper shaft, and coupled to the driving cam such that the first transmission member can be swung and such that, when the driving cam is rotated, the first transmission member is swung; and a second transmission member coupled to the link mechanism, and provided to the feed upper shaft such that the second transmission member can be swung, such that the second transmission member can be moved in an axial direction of the feed upper shaft, and such that, when the second transmission member is moved in the axial direction of the feed upper shaft, the second transmission member is switched between a first position at which the second transmission member is coupled to the first transmission member and a second position at which the second transmission member is away from and disconnected from the first member.

* * * * *